US009403615B2

(12) United States Patent
Block et al.

(10) Patent No.: US 9,403,615 B2
(45) Date of Patent: Aug. 2, 2016

(54) CARTON AND HANDLE IN MULTI-PLY CARTON MATERIAL

(75) Inventors: Steven J. Block, Amelia, OH (US); Edward A. Zumbiel, Union, KY (US)

(73) Assignee: The C.W. Zumbiel Company, Hebron, KY (US)

( * ) Notice: Subject to any disclaimer, the term of this patent is extended or adjusted under 35 U.S.C. 154(b) by 0 days.

(21) Appl. No.: 13/053,384

(22) Filed: Mar. 22, 2011

(65) Prior Publication Data

US 2011/0233091 A1 Sep. 29, 2011

Related U.S. Application Data

(60) Provisional application No. 61/318,015, filed on Mar. 26, 2010, provisional application No. 61/346,602, filed on May 20, 2010.

(51) Int. Cl.
*B65D 75/00* (2006.01)
*B65D 5/02* (2006.01)
(Continued)

(52) U.S. Cl.
CPC ..... *B65D 5/0227* (2013.01); *B65D 5/4608* (2013.01); *B65D 5/5405* (2013.01);
(Continued)

(58) Field of Classification Search
CPC ..... B65D 2571/0066
USPC ..... 206/427, 434, 141, 155; 229/117.12, 229/117.13, 243, 87.01, 87.04, 89, 117.14, 229/117.15, 117.3–117.16
See application file for complete search history.

(56) References Cited

U.S. PATENT DOCUMENTS 2,681,143 A 6/1954 Guyer
2,802,616 A * 8/1957 Caster et al. ..... 229/117.12
(Continued)

FOREIGN PATENT DOCUMENTS

DE 7902469 U1 5/1979
WO 2009/043056 A2 4/2009

OTHER PUBLICATIONS

International Search Report and Written Opinion of the International Searching Authority, or the Declaration, PCT/US2011/029730; May 27, 2011, 10 pgs.
(Continued)

*Primary Examiner* — Jacob K Ackun
*Assistant Examiner* — Jenine Pagan
(74) *Attorney, Agent, or Firm* — Wood, Herron & Evans, LLP

(57) ABSTRACT

A carton blank is assembled into a carton for beverage containers, the blank having a number of panels including a top panel, a bottom panel and a pair of side panels each joined by a fold line to an adjacent one of the panels. A number of end flaps are each joined by an end flap fold line to one of the panels and the end flaps are adapted to be folded upon selected other end flaps to form composite end panels of the carton. A carrying handle is formed in a selected one of the panels and adapted to be grasped by a user to carry the erected carton filled with the beverage containers. The blank includes a primary reinforcing panel joined to one of the panels such that the primary reinforcing panel may be folded into face to face juxtaposition with the selected one of the panels. A secondary reinforcing panel is joined to one of the panels via a secondary reinforcing panel fold line about which the secondary reinforcing panel may be folded into face to face juxtaposition with at least one of the primary reinforcing panel and the selected one of the panels. When the primary and secondary reinforcing panels are folded into position, at least portions of the selected one of the panels surrounding the handle have a triple layer of thickness.

20 Claims, 31 Drawing Sheets

(51) Int. Cl.

| | |
|---|---|
| ***B65D 5/468*** | (2006.01) |
| ***B65D 5/54*** | (2006.01) |
| ***B65D 71/30*** | (2006.01) |
| ***B65D 71/36*** | (2006.01) |

(52) U.S. Cl.

CPC ..... *B65D 71/30* (2013.01); *B65D 71/36* (2013.01); *B65D 2571/0045* (2013.01); *B65D 2571/0066* (2013.01); *B65D 2571/00141* (2013.01); *B65D 2571/00271* (2013.01); *B65D 2571/00524* (2013.01); *B65D 2571/00543* (2013.01); *B65D 2571/00574* (2013.01); *B65D 2571/00728* (2013.01)

(56) References Cited

U.S. PATENT DOCUMENTS

| | | | | | |
|---|---|---|---|---|---|
| 3,904,036 | A | | 9/1975 | Forrer | |
| 3,994,432 | A | * | 11/1976 | Kirby, Jr. | 229/117.13 |
| 4,331,289 | A | * | 5/1982 | Killy | 229/117.13 |
| 4,577,799 | A | | 3/1986 | Oliff | |
| 4,784,316 | A | | 11/1988 | Crouch | |
| 4,785,991 | A | | 11/1988 | Schuster | |
| 4,830,267 | A | * | 5/1989 | Wilson | 206/141 |
| 5,106,014 | A | | 4/1992 | Miller | |
| 5,119,985 | A | * | 6/1992 | Dawson et al. | 229/117.13 |
| 5,222,658 | A | | 6/1993 | DeMaio et al. | |
| 5,234,102 | A | * | 8/1993 | Schuster et al. | 206/141 |
| 5,297,725 | A | * | 3/1994 | Sutherland | 229/117.13 |
| 5,379,944 | A | | 1/1995 | Stout et al. | |
| 5,655,705 | A | | 8/1997 | Bates | |
| 5,738,273 | A | | 4/1998 | Auclair | |
| 5,794,778 | A | | 8/1998 | Harris | |
| 6,021,899 | A | | 2/2000 | Sutherland | |
| 6,170,741 | B1 | | 1/2001 | Skolik et al. | |
| 6,237,839 | B1 | | 5/2001 | Brown | |
| 6,425,520 | B1 | | 7/2002 | Peterson | |
| 6,766,940 | B2 | * | 7/2004 | Negelen | 229/117.13 |
| 6,899,221 | B2 | | 5/2005 | Skolik et al. | |
| 6,905,066 | B2 | * | 6/2005 | Holley et al. | 229/117.13 |
| 6,948,293 | B1 | | 9/2005 | Eckermann et al. | |
| 6,971,572 | B2 | | 12/2005 | Ikeda | |
| 6,974,072 | B2 | | 12/2005 | Harrelson | |
| 7,673,787 | B2 | | 3/2010 | Mittelstaedt | |
| 8,070,052 | B2 | | 12/2011 | Spivey, Sr. et al. | |
| 8,118,212 | B2 | | 2/2012 | Miller | |
| 8,216,118 | B2 | | 7/2012 | Dunn | |
| 8,827,143 | B2 | | 9/2014 | Schuster | |
| 2004/0089671 | A1 | | 5/2004 | Miller | |
| 2004/0104134 | A1 | | 6/2004 | Skolik et al. | |
| 2007/0017962 | A1 | | 1/2007 | Russ | |
| 2007/0062834 | A1 | * | 3/2007 | Harrelson | 206/427 |
| 2007/0205255 | A1 | | 9/2007 | Dunn | |
| 2008/0099544 | A1 | | 5/2008 | Skolik | |
| 2008/0237322 | A1 | * | 10/2008 | Mittelstaedt | 229/117.16 |
| 2008/0290147 | A1 | | 11/2008 | Skolik et al. | |
| 2009/0236408 | A1 | | 9/2009 | Spivey, Sr. et al. | |
| 2011/0233091 | A1 | | 9/2011 | Block et al. | |

OTHER PUBLICATIONS

European Patent Office, Supplementary Partial European Search Report, EP 11760189, Dec. 19, 2014, 5 pgs.

* cited by examiner

CARTON AND HANDLE IN MULTI-PLY CARTON MATERIAL

This claims the benefit of U.S. Provisional Patent Application Ser. No. 61/318,015, filed Mar. 26, 2010, and U.S. Provisional Patent Application Ser. No. 61/346,602, filed May 20, 2010, each of which is hereby incorporated by reference in its entirety.

BACKGROUND OF THE INVENTION

This invention relates to cartons, and more particularly, to a beverage container carton having a carrying handle.

In the marketing of soft drinks, beer and other beverages, it is well known to sell those retail consumer products in containers, such as cans, glass bottles, PET bottles or other containers which are grouped together in packs of four, six, eight, ten, twelve, twenty-four or any number of containers. Particularly in the case of twelve packs, it is common to package the containers in cartons so as to make it easier to handle the product for the wholesaler and the retailer, as well as for the retail consumer.

A wide variety of different types of container cartons are known. One particular type that has found significant commercial success over the years is a so-called wraparound or sleeve-style carton. In a wraparound carton, a number of containers, e.g., twelve, are wrapped in a paperboard box or carton having a top and bottom wall panels, side wall panels, and end flaps on each end. The end flaps at each end of the top, bottom and side panels are sealed one to the other, thereby providing a closed end and sealed package or carton for the containers.

With this and many types of container carton packages, a carrying handle is often provided on the carton so that both the retailer and retail consumer can more easily carry the carton. A number of different carrying handles are known in the wraparound carton art. The overall purpose of such carton handles is to provide an easy to use handle that is structurally sound so the users can pick up and carry the wraparound carton simply through use of the handle structure without concern that the carton or handle will rip or fail.

Wraparound cartons of this type are commonly punched or die-cut from paperboard material. Different paperboard characteristics such as the composition and thickness offer differing amounts of strength, particularly tear strength, to the material and, as such, the resulting carton. Naturally, thicker, denser and stronger paperboard stock is typically more expensive and carton manufacturers who produce great quantities of paperboard cartons are interested in providing the most economical carton without sacrificing functionality, including carton strength. Paperboard stock that is thinner and made from non-virgin pulp is often less expensive than thicker stock made from virgin pulp, but the strength characteristics of such paperboard stock are also often lower. As such, carton designers endeavor to utilize the most economical paperboard stock while providing the requisite functionality and strength to the carton design.

Moreover, the use of different types of paperboard has a significantly different environmental impact. For example, two common types of paperboard utilized in beverage container cartons are coated recycled board (CRB) and coated unbleached kraftboard (CUK). As the name implies, the CRB is made from 100% recycled components, while the CUK is made from only 20% recycled materials. Environmental impact analysis has shown that the use of CRB is drastically more environmentally beneficial than the use of CUK with significant reductions in wood use, net energy consumption, overall energy for production, sulfur dioxide and nitrogen oxide generation ($SO_2$ and $NO_x$), greenhouse gas emissions, hazardous air pollutants (HAP), volatile organic compounds (VOCs), total reduced sulfur (TRS), wastewater generation, biochemical and chemical oxygen demand (BOD and COD), and solid waste.

In some prior art carton designs, the top panel portions of the carton are adhesively bonded together so as to overlap and for closing the wraparound carton and reinforcing a handle area between two handle openings in the top panel portions. One particular design disclosed in U.S. Pat. No. 6,170,741 includes a separate sheet or insert of material for reinforcement of the inner top panel portions which is bonded to it, presumably to allow for the use of cheaper paperboard stock without sacrificing carton strength in the top panel and handle areas.

In particular, the carton disclosed in the '741 patent includes a first blank forming the various panels, including the handle containing panel, when folded into the wraparound configuration. An added separate sheet of paperboard is an insert that is glued to the interior surface of the top panel to reinforce the top panel handle area. While this arrangement may allow for the use of thinner and/or weaker, less expensive carton materials, it greatly reduces the production and assembly rates and manufacturing efficiency for the carton. The need to produce the insert in a separate manufacturing operation, the need to match, align and join the insert with the primary blank, and the need to acquire, utilize and maintain specialized equipment for the process results in increased cost and increased process complexity. The need to match, align and join the insert with the primary blank requires slower line speeds, results in more quality control problems, greater cost and complexity and greater paperboard consumption.

Taking this into consideration, it is one object of this invention to provide a beverage carton which has the necessary tear strength and rigidity in the area surrounding the handle, but is more cost-effective, utilizing thinner and/or environmentally friendly paperboard and which can be produced at or near top line speeds and production rates.

Accordingly, it has been another objective of this invention to provide a novel carrying handle for a carton and, particularly, for a wraparound type carton, where the handle's structural components are formed directly from the carton blank. And with this type of handle, it is another objective of this invention to provide an improved carrying handle structure which maintains the structural integrity of the wraparound carton through the distribution chain until it is chosen by a retail consumer, which is very easy to render usable, and to use, by the retail consumer once the carton has been so chosen, and which does not adversely impact on the structural integrity of the carton when the handle is punched out of the carton blank.

SUMMARY OF THE INVENTION

These and other drawbacks in the prior art have been addressed and overcome with a blank, carton and handle configuration of this invention. A carton of this invention has a reinforced, multiple ply handle offering added strength and structural support to the carton without the need for additional, separate carton blanks and which can be formed at or near production rates and line speeds achievable with conventional carton designs and materials. Furthermore, the carton is manufactured from thinner paperboard stock of either non-virgin or virgin pulp thereby reducing costs or expenses without sacrificing strength or production rates.

Various embodiments of this invention include a carton blank to be assembled into a carton for beverage containers, the blank having a number of panels including a top panel, a bottom panel and a pair of side panels each joined by a fold line to an adjacent one of the panels. A plurality of end flaps are each joined by an end flap fold line to one of the panels and the end flaps are adapted to be folded upon selected other end flaps to form composite end panels of the carton. A carrying handle is formed in a selected one of the panels and adapted to be grasped by a user to carry the erected carton filled with the beverage containers. The blank includes a primary reinforcing panel joined to one of the panels such that the primary reinforcing panel may be folded into face to face juxtaposition with the selected one of the panels. A secondary reinforcing panel is joined to one of the panels via a secondary reinforcing panel fold line about which the secondary reinforcing panel may be folded into face to face juxtaposition with at least one of the primary reinforcing panel and the selected one of the panels. When the primary and secondary reinforcing panels are folded into position, at least portions of the selected one of the panels surrounding the handle have a triple layer of thickness or three plies thereby providing added strength to the handle structure. Cartons according to this invention with the triple layer of material surrounding the handle have been tested to provide at least 2.5 times the tear resistance of single ply carton designs utilizing the same materials (i.e., virgin kraftboard) according to tests conducted on an Elmendorf™ tear test device.

Other embodiments of this invention may include more than the primary and secondary reinforcing panels to provide more than triple-ply support for the handle. Also, a glue tab may be joined by a glue tab fold line to one of the panels and adapted to be adhered to another one of the panels to form the panels into a tubular configuration for loading the beverage containers therein. Other embodiments may include handle apertures in each of the primary and secondary reinforcing panels adapted to be registered with the carrying handle when the primary and secondary reinforcing panels are folded into position. Advantageously, the reinforcing panels and carrying handle arrangement do not interfere with a well formed, clean carton manufacturer's seam formed by the glue flap of this invention. The carrying handle may be positioned off-center laterally on the selected one of the panels to better facilitate gluing of the blank into the tubular configuration. Other embodiments may include a dispenser formed in the blank through which a user may access the beverage containers in the formed carton.

In still further embodiments, a pattern of stress relieving score lines are provided in the blank and positioned relative to the carrying handle so as to distribute lifting stresses exerted on the carton to avoid tearing the panels. The blank may be made from recycled pulp and the components of the blank are of single piece construction integral joined together from a single sheet of paperboard material. Alternatively, the blank may be made of a single sheet of laminate materials including combinations of any type of paperboard, fiber, plastic or other materials. The beverage containers may be arranged in the erected carton in a 2×6 arrangement with their longitudinal axes oriented generally perpendicular to the selected one of the panels, 3×4 arrangements, 4×6 arrangements or another arrangement. The containers may be cans or bottles made out of metal, plastic, glass or another material.

Other embodiments of this invention include a beverage container carton, a package including a carton and beverage containers, and a method of forming a carton for beverage containers.

BRIEF DESCRIPTION OF THE DRAWINGS

The above-mentioned and other features and advantages of this invention, and one manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
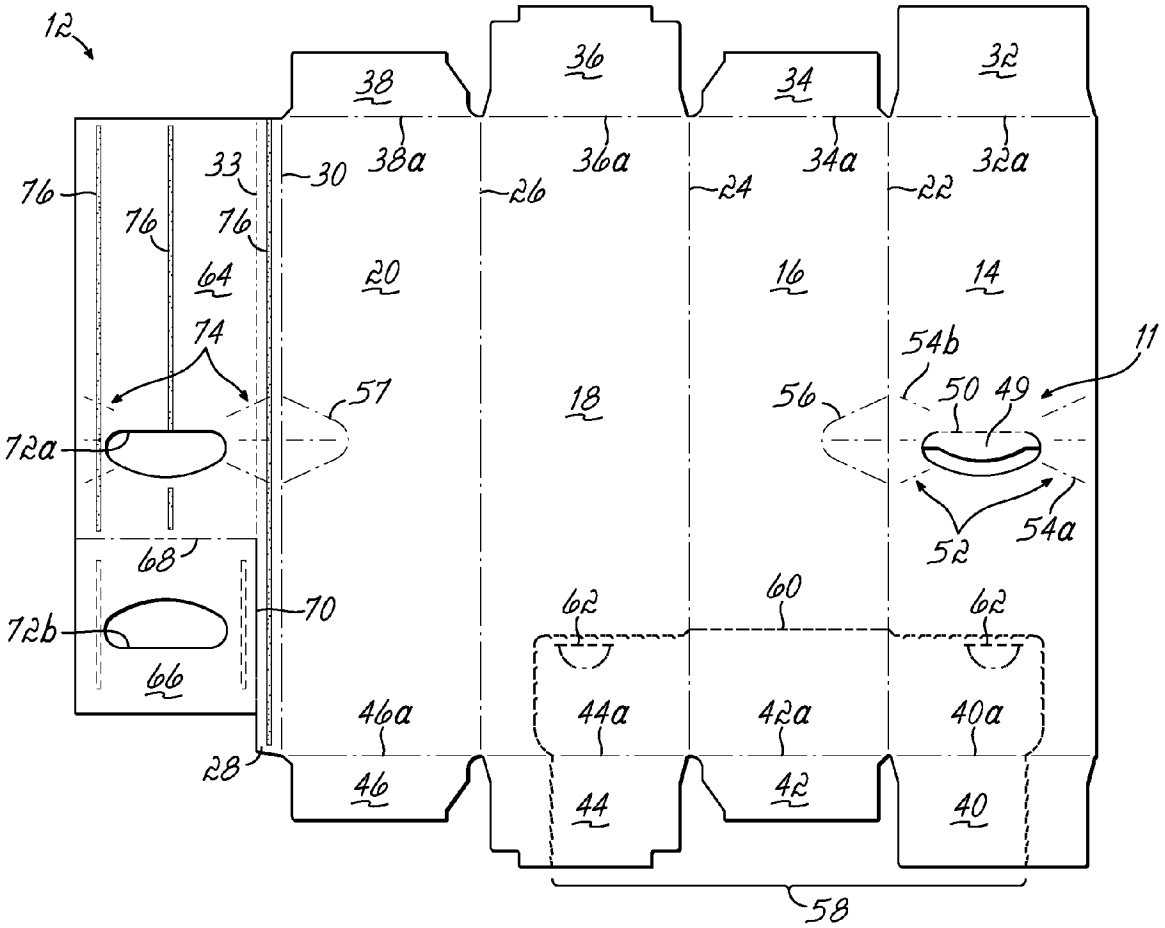
FIG. 1 is a top plan view of a print side of a blank used to construct a carton according to one embodiment of this invention.
Figure 2:
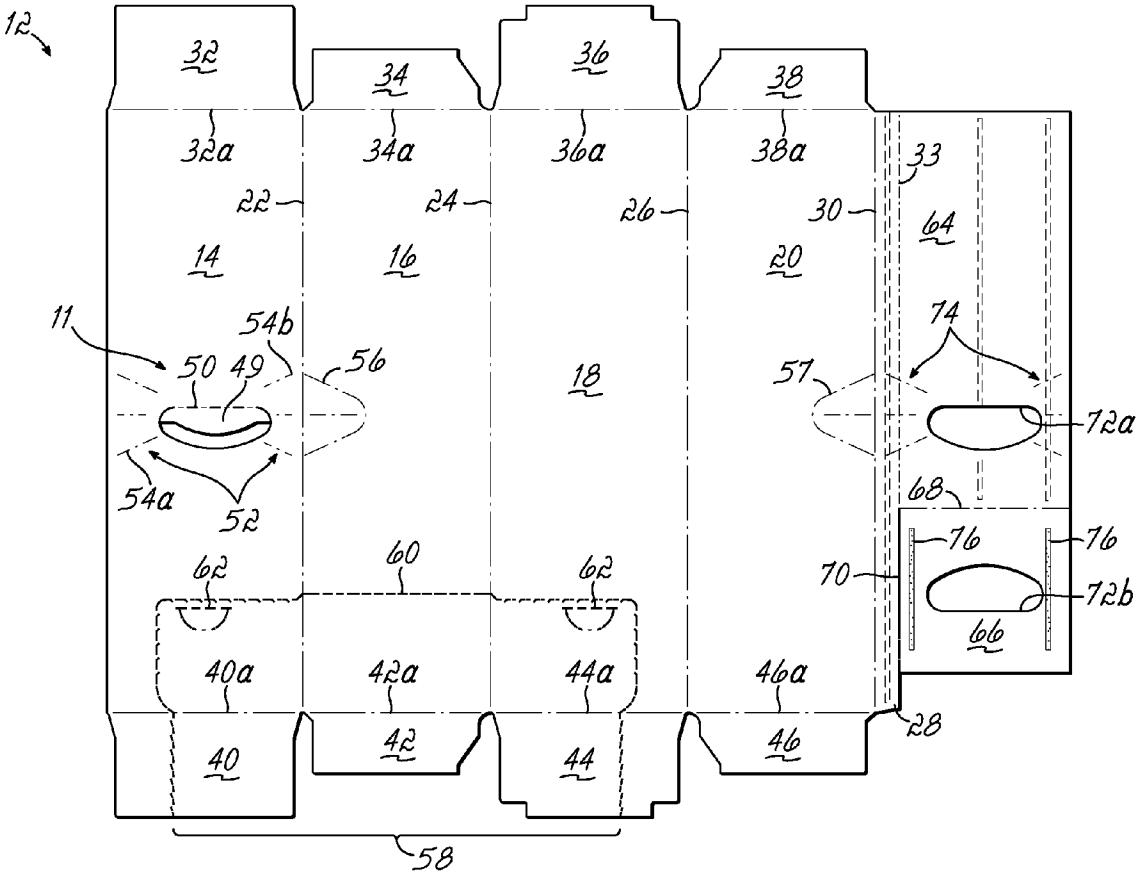
FIG. 2 is a plan view of the opposite, non-print side of the blank of FIG. 1.
Figure 10:
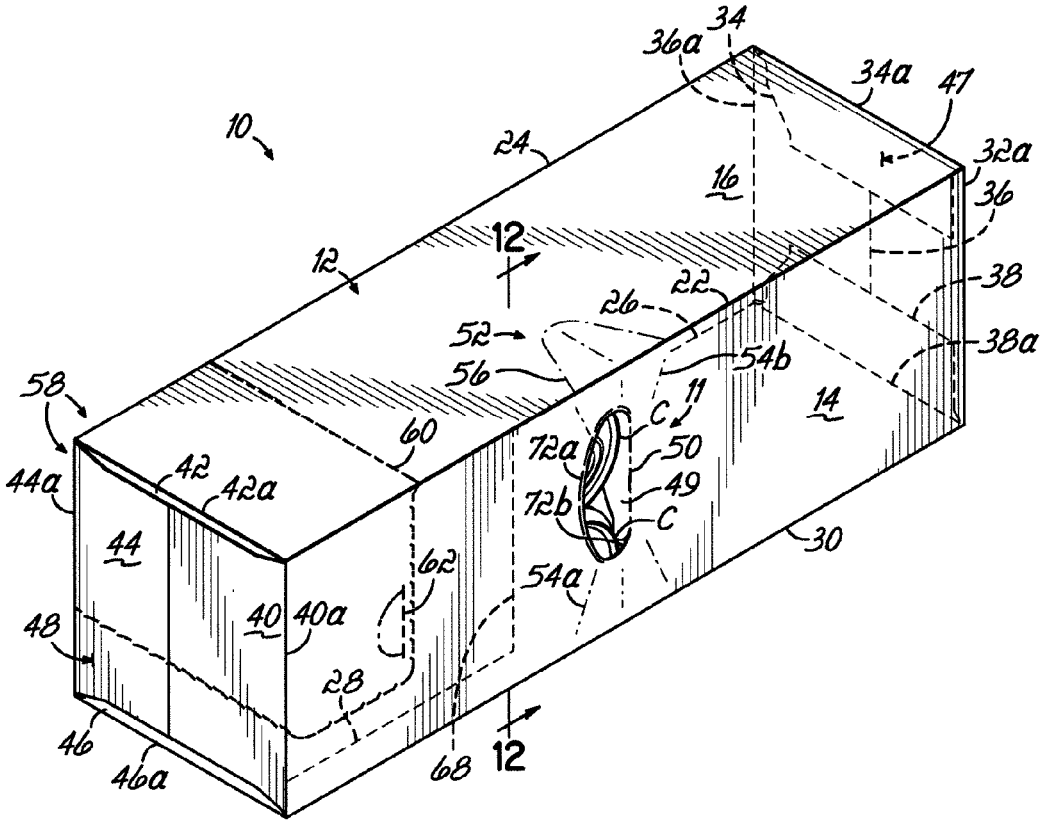
FIG. 10 is a perspective view of the erected carton from the blank of FIGS. 1-2 with beverage containers oriented laterally between opposing sidewalls of the carton, one of which includes a handle.
Figure 11:
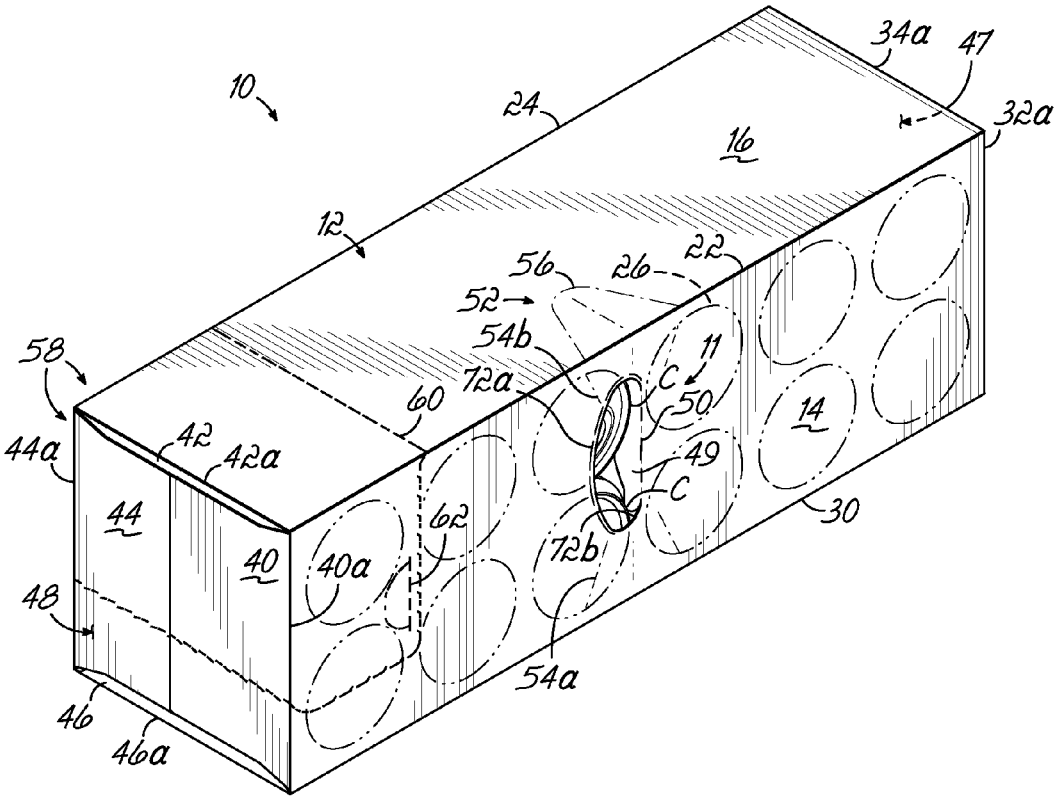
FIG. 11 is a view similar to FIG. 10 showing the top end of each container in phantom.

FIGS. 10 to 14 illustrate a carton 10 having a carrying handle 11 in accordance with one of the embodiments of this invention. FIGS. 1-2 illustrate a blank 12 from which the carton 10 of FIG. 10 is formed. Containers "C" arranged in a 2×6 array are shown in FIGS. 10-11 as an aid in understanding the invention. However, the various embodiments of this invention are applicable to other types of containers (glass bottles, PET bottles, etc.) as well as other container arrangements (3×4, 4×6, 2×2, etc.). More specifically in the embodiment shown in FIGS. 1-2, the containers "C" are arranged in a group consisting of two vertically disposed tiers each including six 12 ounce cans. The containers "C" in each tier are disposed on their sides in a side-by-side parallel fashion.

Referring to FIGS. 1-2, the blank 12 includes four primary panels for forming the carton walls, i.e., a first side panel 14, a top panel 16, a second side panel 18 and a bottom panel 20 foldably connected one to the next along fold lines 22, 24 and 26. A glue flap 28 is foldably connected to bottom panel 20 along fold line 30. Reference numerals 32, 34, 36, 38, and 40, 42, 44, 46 designate end flaps foldably connected the ends of the panels 14, 16, 18 and 20, respectively. Each end flap 32, 34, 36, 38, 40, 42, 44, 46 is joined to the associated panel 14, 16, 18, 20 by a fold line 32*a*, 34*a*, 36*a*, 38*a*, 40*a*, 42*a*, 44*a*, 46*a*, respectively. The end flaps 32, 34, 36 and 38 arranged along the upper edge (as viewed in FIG. 1) of the blank 12 form a first composite end wall 47. The end flaps 40, 42, 44 and 46 arranged along the lower edge of FIG. 1 form a second composite end wall 48 as shown in FIG. 10.

FIG. 1 shows a print side of the blank 12; whereas, FIG. 2 shows the opposite face of a non-print side of the blank 12. Referring to FIG. 1, the carrying handle 11 is formed in the side panel 14 and includes a handle flap 49 joined to a remainder of the panel 14 by a combination of fold and cut lines 50 so that when the user grasps the handle 11, the flap 49 may be folded inwardly toward the non-print side for convenient use.

A pattern 52 of stress-relieving score lines are formed in the blank 12 surrounding the carrying handle 11 in the first side panel 14 and the adjacent top and bottom panels 16, 20 of the blank 12 of FIGS. 1 and 2. The pattern 52 of stress-relieving score lines includes score lines 54*a*, 54*b* radiating angularly outward from opposite ends of the carrying handle 11 in the side panel 14. Additional stress-relieving score lines 56, 57 are formed adjacent the carrying handle 11 in the top and bottom panels 16, 20 as shown in FIGS. 1 and 2. The purpose of the stress relieving score lines 54*a*, 54*b*, 56 and 57 is to distribute the lifting stresses exerted on the carton so that the panels of the carton do not tear and control or minimize buckling of the carton when lifted.

A dispenser 58 is formed from appropriate tear lines 60 and finger holes 62 in the carton blank 12 to provide access to the containers C inside the erected carton 10. The dispenser 58 shown herein is merely an exemplary dispenser and any of a wide variety of dispenser configurations and designs can be utilized with this invention, including the dispenser shown in U.S. Patent Application Publication No. 2004/0089671, assigned to the assignee of this invention and hereby incorporated by reference in its entirety.

As shown in the blank 12 of embodiments of FIGS. 1-2, a primary reinforcing panel 64 is joined to the glue flap 28 adjacent the bottom panel 20. A secondary reinforcing panel 66 is joined to a longitudinal distal end of the primary reinforcing panel 64 along a secondary reinforcing panel fold line 68. A cut line 70 is formed between the adjacent edges of the secondary reinforcing panel 66 and the glue flap 28 to permit the secondary reinforcing panel 66 to be pivoted about the secondary reinforcing panel fold line 68 onto the primary reinforcing panel 64. Line 33 is an extension of cut line 70 to demarcate the glue flap 28 from the panels 64, 66. Handle apertures 72*a*, 72*b* are provided in each of the primary and secondary reinforcing panels 64, 66, respectively, and are mirror images of one another about the secondary reinforcing panel fold line 68 so that when the reinforcing panels 64, 66 are in face-to-face juxtaposition, the respective apertures 72*a*, 72*b* are in alignment and registration.

Additionally, in the primary reinforcing panel 64, a second pattern 74 of stress-relieving score lines is provided which are complimentary to the pattern 52 of stress-relieving score lines in the first side panel 14. The stress-relieving score lines 57 are also included in the adjacent bottom panel 20 of the carton blank 12.

As shown in FIG. 1, glue lines 76 are provided on the print side of the glue flap 28 as well as on the primary reinforcing panel 64. Additionally, as shown in FIG. 2, glue lines 76 are provided on the non-print side of the secondary reinforcing panel 66 to adhere that panel to the primary reinforcing panel 64. The glue line 76 on the glue flap 28 adheres the glue flap to the top panel 16 adjacent the fold line 30 and the glue lines 76 on the primary reinforcing panel 64 adhere that panel as well as the secondary reinforcing panel 66 to the non-print surface of the first side panel 14 containing the carrying handle 11 as will be described later herein. The glue flap 28 configuration advantageously affords the carton 10 with a well-formed, clean and secure seam when the blank 12 is formed into a tubular configuration and without interference from the reinforcing panels 64, 66. Specifically, since the secondary reinforcing panel 66 is attached to and folded upon the primary reinforcing layer 64, the glue flap 28 which is contiguous with the primary reinforcing layer 64 remains on the same elevation or plane as the primary reinforcing layer 64. In this way when the glue flap 28 is joined to the first side panel 14, there is a flat even area (same plane) for the seam while still providing for the multiple ply reinforcing area surrounding the carrying handle 11.

Figure 6:
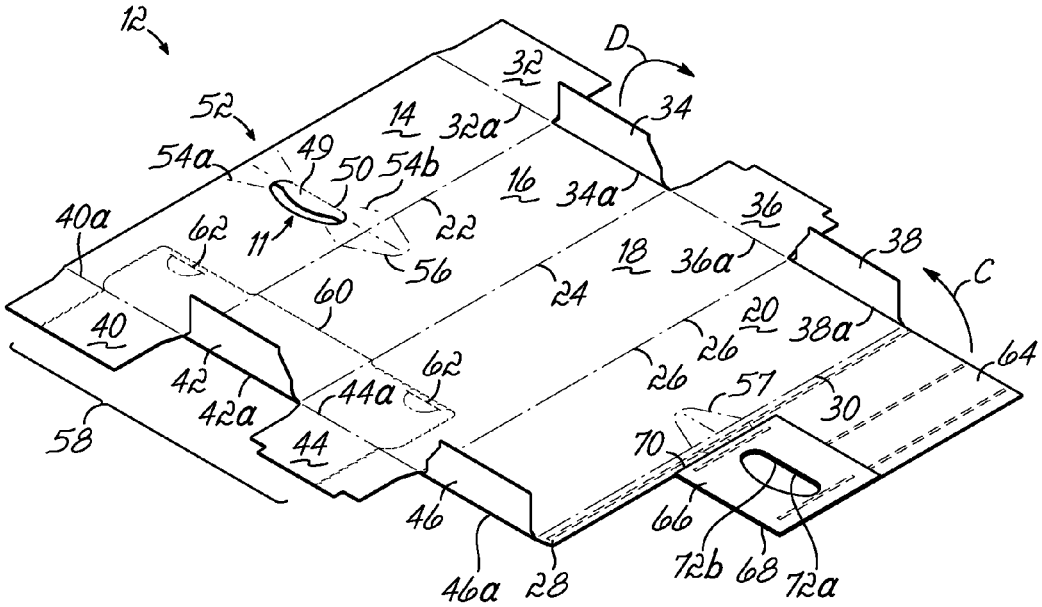

Referring to FIGS. 5-8, to form an erected carton 10 from the blank 12 of FIGS. 1-2, one sequence begins with folding the secondary reinforcing panel 64 upwardly in the direction of arrow A toward the primary reinforcing panel 66 until it is in face-to-face juxtaposition therewith and the handle apertures 72*a*, 72*b* are in registration as shown in FIG. 6. The secondary reinforcing panel 66 is adhered to the primary reinforcing panel 64 by the glue lines. Additionally, the end flaps 42, 46, 34, 38 on the opposite ends of the top and bottom panels 16, 20 are folded upwardly in the direction of arrows B so as to be generally perpendicular to their associated panels.

Referring to FIG. 6, the primary and secondary reinforcing panels 64, 66, as well as the adjoined glue flap 28 are folded upwardly in the direction of arrow C so as to be generally perpendicular to the adjacent bottom panel 20. The top and first side panels 16, 14 are folded upwardly in the direction of arrow D so as to be generally perpendicular to the second side panel 18 and bottom panel 20.

Figure 7:
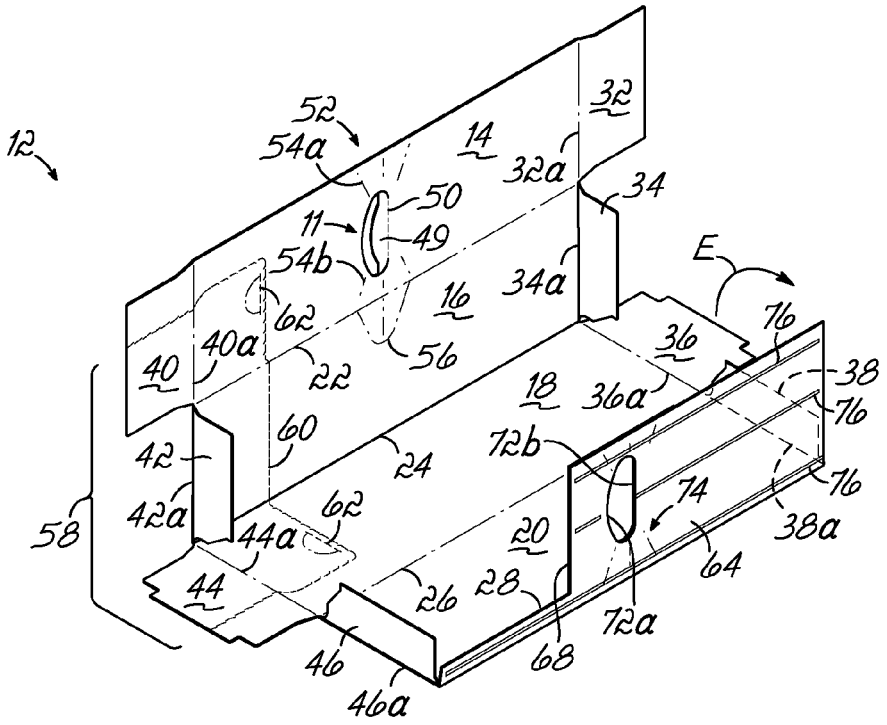
Figure 8:
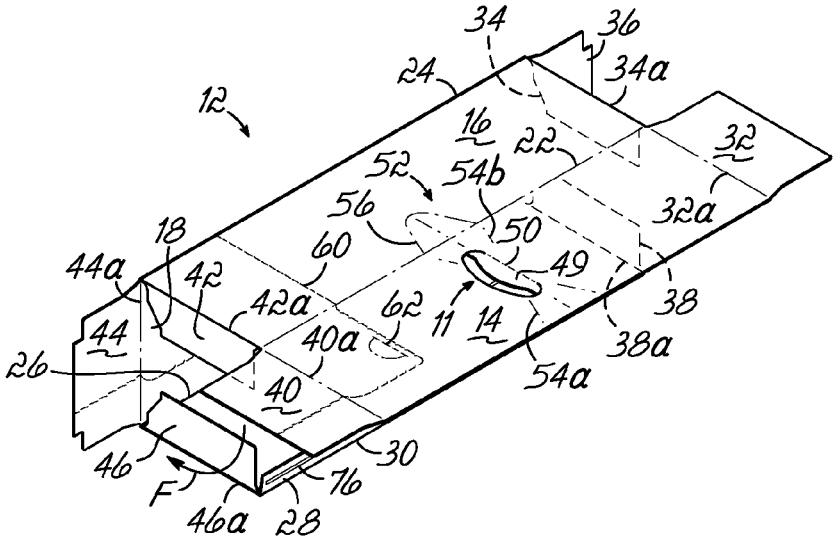
Figure 9:
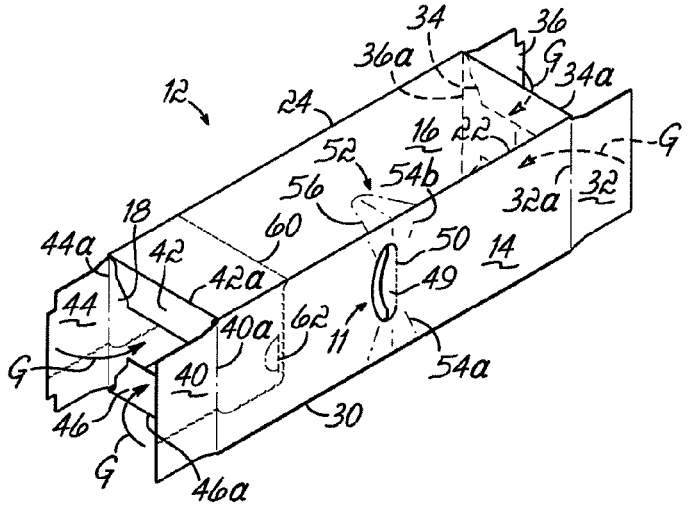

Referring to FIG. 7, the bottom panel 20 and first side panel 14 are folded inwardly toward one another so that the primary and secondary reinforcing panels 64, 66 underlie the first side panel 14 with the handle apertures 72 aligned with the carrying handle 11. The glue lines 76 on the primary reinforcing panel 64 adhere that panel to the non-print side of the first side panel 14 and the glue lines 76 on the glue flap 28 likewise adheres the glue flap 28 to the non-print side of the first side panel 14 thereby forming the carton blank 11 into a tubular configuration. The carton 10 may be in a flat tubular configuration and expanded into an open-ended tubular form into which the containers C are loaded through one or both of the open ends of the carton 10. The end flaps 32, 34, 36, 38, 40, 42, 44, 46 are folded and glued to form the respective end walls to thereby close the ends of the carton 10. To form the end walls, the top and bottom end flaps 34, 42, 38, 46 are folded to their respective positions generally perpendicular to the associated panel 16, 20. Glue is applied to the outside face of the end flaps 34, 42, 38, 46 to form the composite end walls thereby enclosing the containers C in the carton 10 as shown in FIG. 10. The process steps of erecting the carton blank into a carton may be varied as required for the various applications.

Advantageously, as shown in FIG. 11, the longitudinal ends of the containers C are juxtaposed to the multi-layer side panel 14 and the additional layers provided by the primary and secondary reinforcing panels 64, 66 to help avoid coining or marking on the print side of the carton 10 which is otherwise common resulting from stacking, storing and transporting filled cartons.

Figure 3:
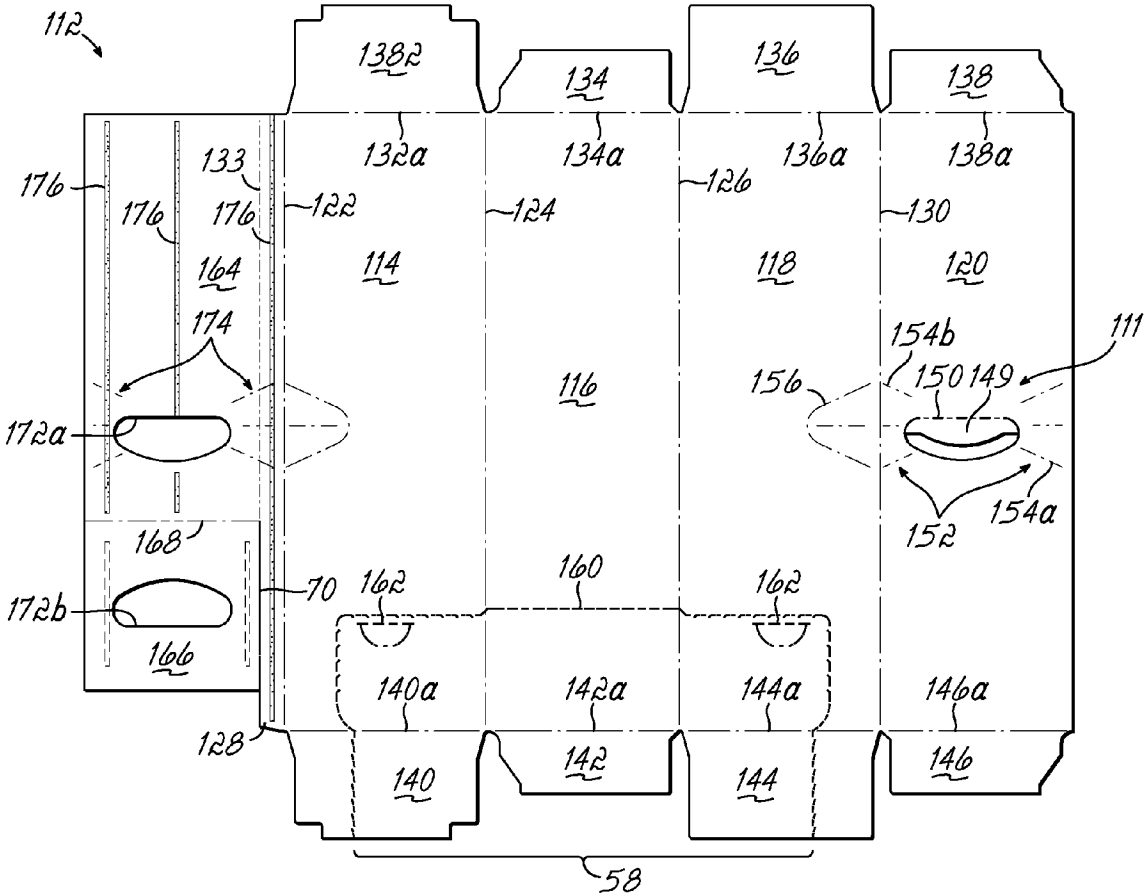
FIG. 3 is a top plan view of a print side of a blank used to form a carton according to a second embodiment of this invention.
Figure 4:
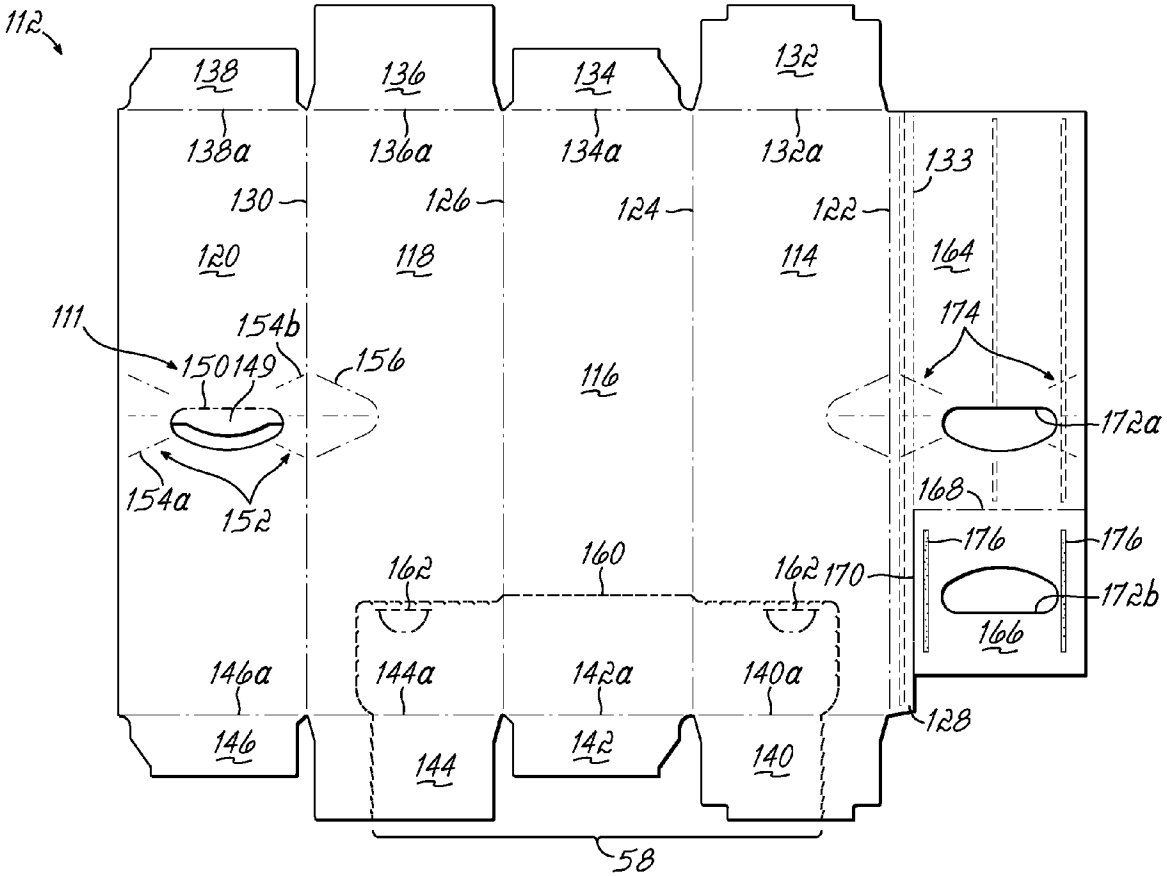
FIG. 4 is a plan view of the opposite, non-print side of the blank of FIG. 3.
Figure 5:
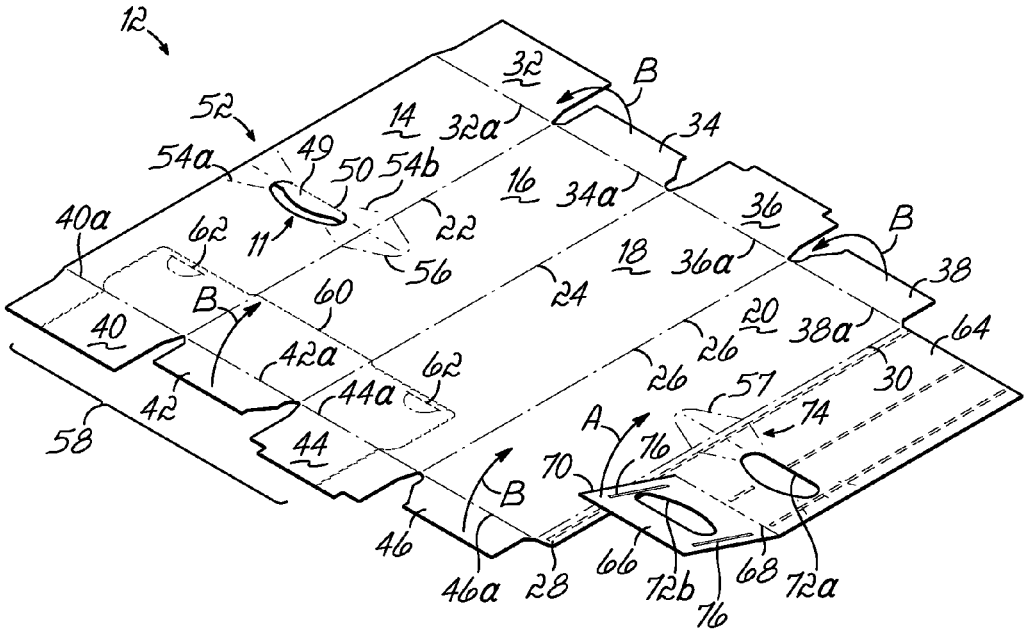
FIGS. 5-9 are sequential perspective views showing the folding operation according to one embodiment of this invention to transform the blanks of FIGS. 1 and 2 into tubular sleeves and subsequently filled cartons.
Figure 13:
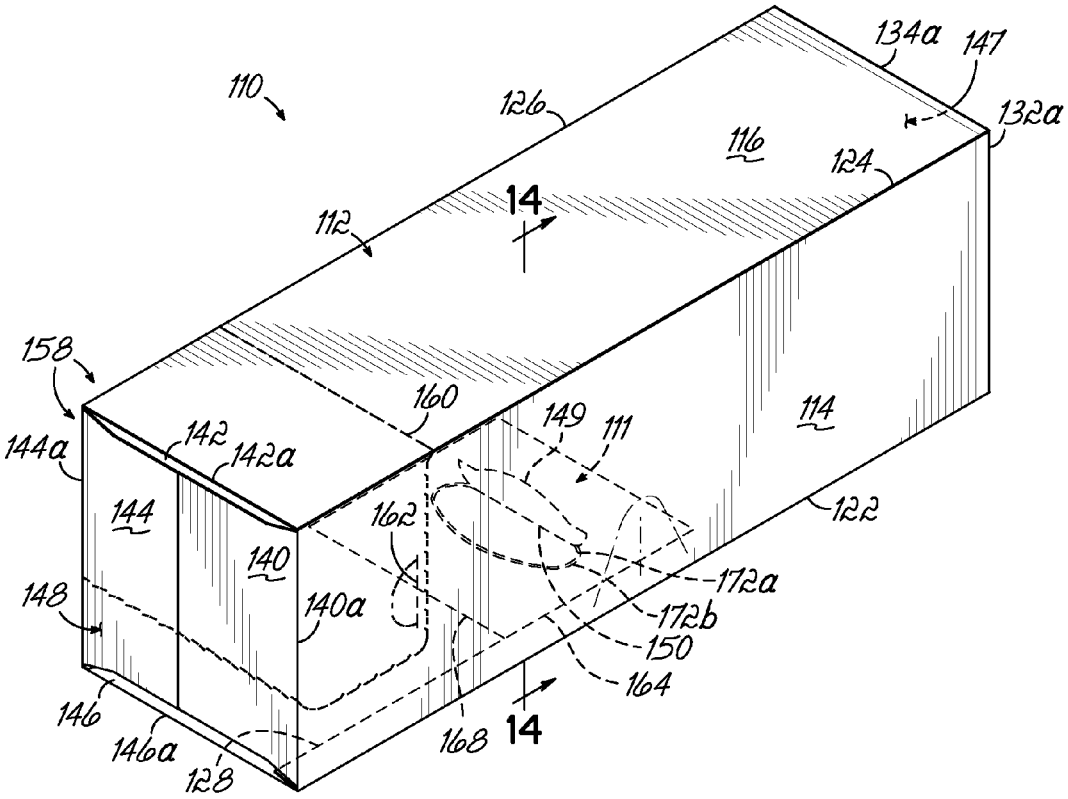
FIG. 13 is a perspective view of a carton assembled from the blank of FIGS. 3-4 with the handle formed on a bottom panel of the carton.
Figure 14:
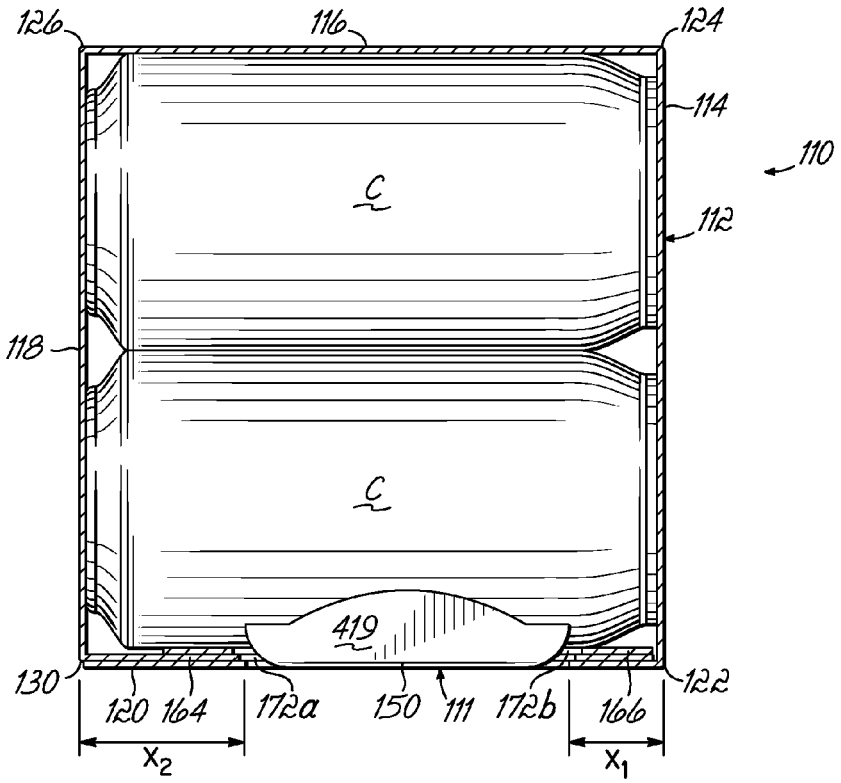
FIG. 14 is a cross-sectional view taken along line 14-14 of FIG. 13 showing containers contained within the carton.

In an alternative embodiment, the carton blank 112 of FIGS. 3 and 4 positions the carrying handle 111 on the bottom panel 120 of the blank as opposed to one of the side panels 114, 118. As such, the glue flap 128 and adjoining primary and secondary reinforcing panels 164, 166 are joined to one of the side panels 114, 118. Line 133 is an extension of cut line 170 to demarcate the glue flap 128 from the panels 164, 166. Secondary reinforcing panel 166 is joined to a distal edge of panel 164 along fold line 168. The erected carton no from the blank 112 of FIGS. 3 and 4 is shown in FIGS. 13-14.

A dispenser 158 according to this embodiment of the invention is formed in part by the top panel 116, side panels 114, 118 and corresponding end flaps 140, 142, 144, 146 on a dispensing end of the carton 110.

Figure 3A:
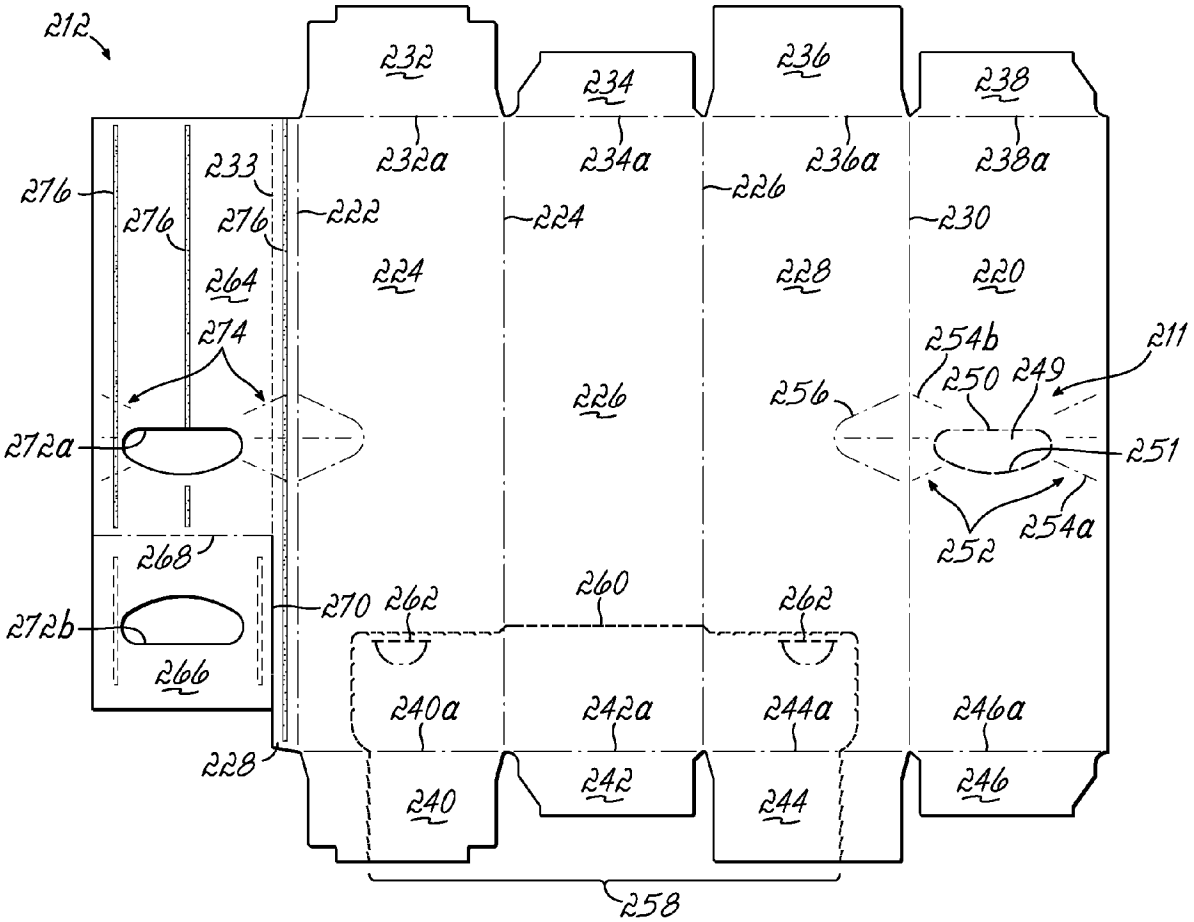
FIG. 3A is a view similar to FIG. 3 of an alternative embodiment of a blank utilizing a different handle configuration.

FIG. 3A is an alternative embodiment of a carton blank 212, similar to the blank 112 of FIG. 3, but with a modified carrying handle 211. The carrying handle 211 of this embodiment includes a full flap 249 and is formed in the bottom panel 220 and includes a handle flap 249 joined to a remainder of the panel 220 by a combination of fold and cut lines 250 so that when the user grasps the handle 211, the flap 249 may be folded inwardly toward the non-print side for convenient use. A series of nicks 251 surrounds the perimeter of the handle flap 249 from opposite ends of the fold line 250 to permit the user to insert their fingers into the carrying handle 211 and fold the flap 249 and grasp the carton by the carrying handle 211. Components of the carton blank 212 shown in FIG. 3A which are similar to comparable components of the blank 112 are identified by similar reference numerals utilizing the 200 series of numbers.

Figure 3B:
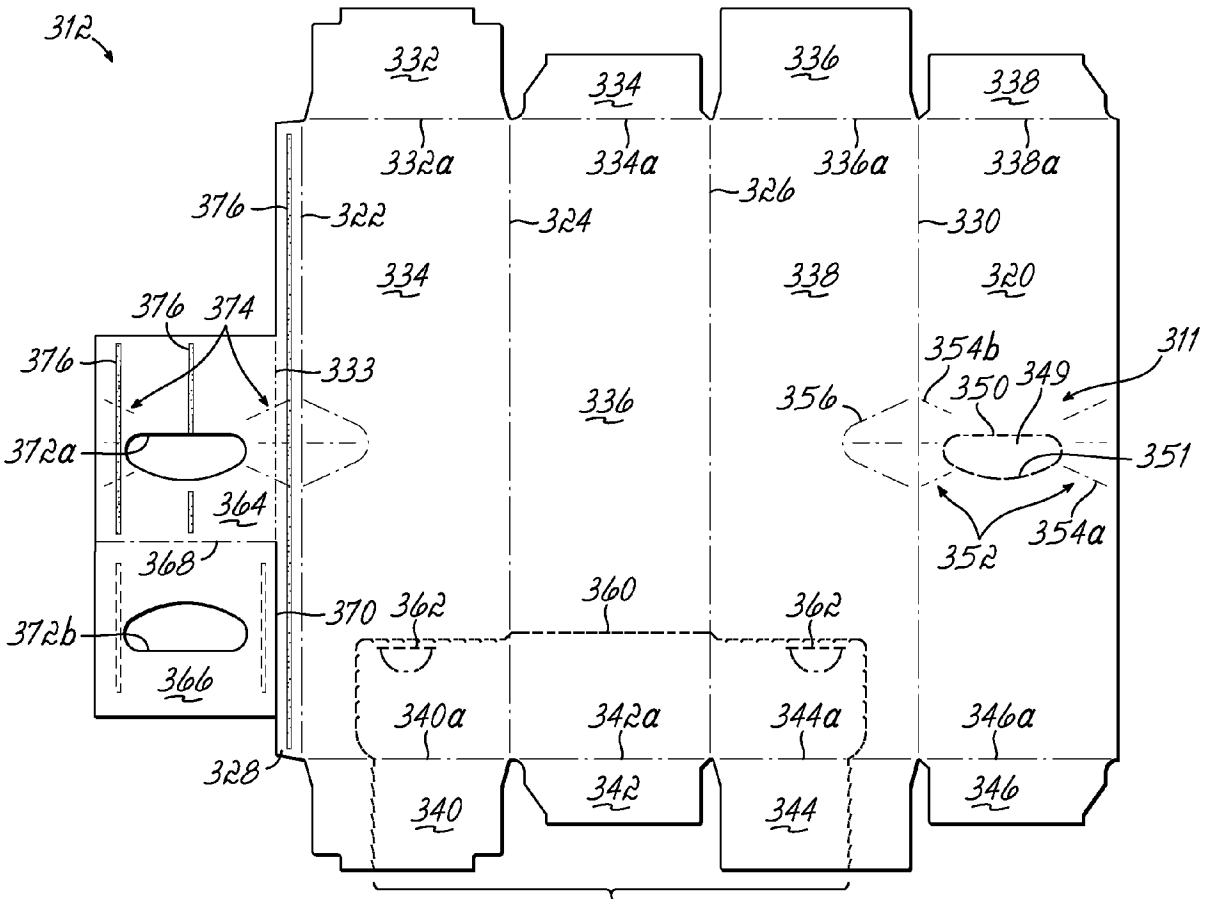
FIG. 3B is a view similar to FIG. 3A of an alternative embodiment of a blank according to this invention.

Referring to FIG. 3B, an alternative embodiment of a carton blank 312, similar to that shown in FIG. 3, is shown although the blank 312 of FIG. 3B includes a truncated primary reinforcing panel 364 with a reduced length compared to the primary reinforcing panel 164 of the blank 112 of FIG. 3. The glue flap 328 of the blank 312 in FIG. 3B extends the same length and the secondary reinforcing panel 366 is likewise similar to the blank 112 of FIG. 3 as well as the portion of the primary reinforcing panel 366 surrounding the handle aperture 372*a*. The truncated primary reinforcing panel 364 reduces the quantity of paperboard required by the blank 312 and carton of this embodiment while still providing a robust and reinforced carrying handle 311 for the carton. Components of the carton blank 312 shown in FIG. 3B which are similar to comparable components of the blank 112 in FIG. 3 are identified by similar reference numerals utilizing the 300 series of numbers.

Figure 15:
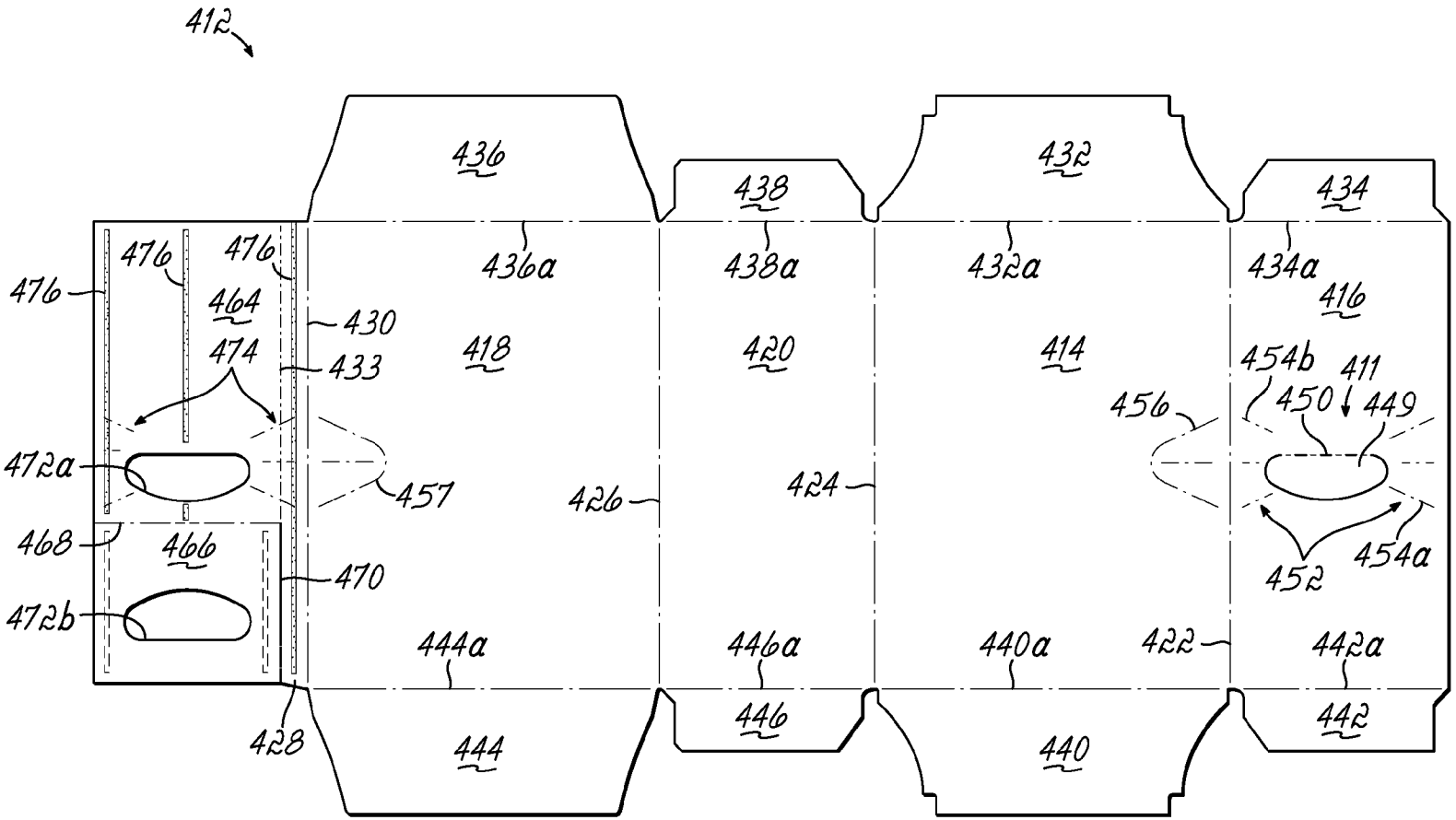
FIG. 15 is a top plan view of a print side of a blank used to construct a carton according to another embodiment of this invention.
Figure 16:
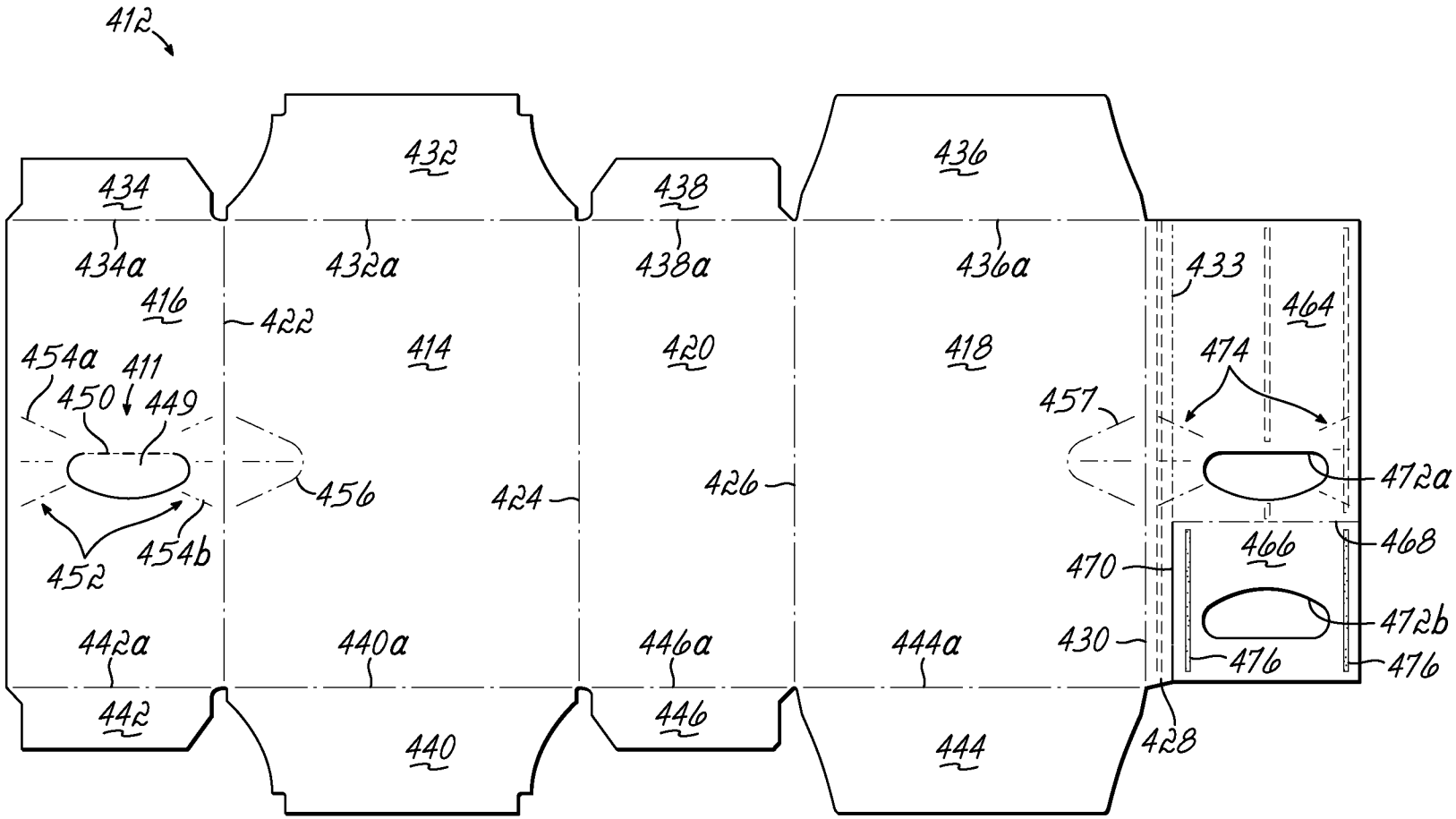
FIG. 16 is a plan view of the opposite, non-print side of the blank of FIG. 15.
Figure 17:
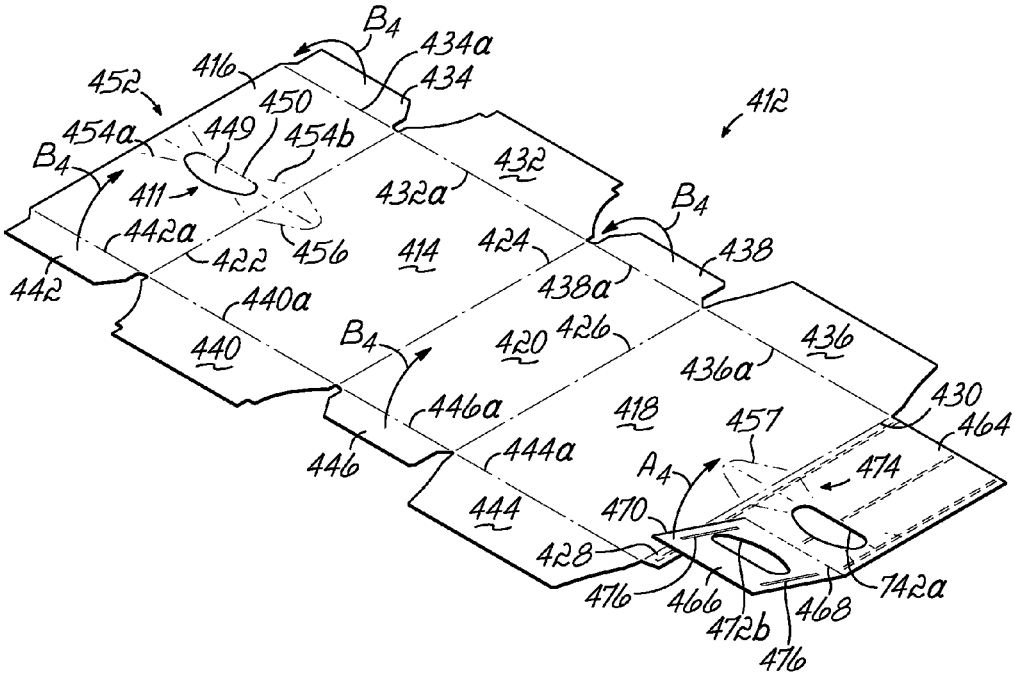
FIGS. 17-23 are sequential perspective views showing the folding operation according to one embodiment of this invention to transform the blanks of FIGS. 15-16 into tubular sleeves and subsequently filled cartons.

Referring to FIGS. 15-16, a blank 412 according to an alternative embodiment of this invention is shown to include four primary panels for forming the carton walls, i.e., a first side panel 414, a top panel 416, a second side panel 418 and a bottom panel 420 foldably connected one to the next along fold lines 422, 424, 426. A glue flap 428 is foldably connected to panel 418 along a fold line 430.

Figure 22:
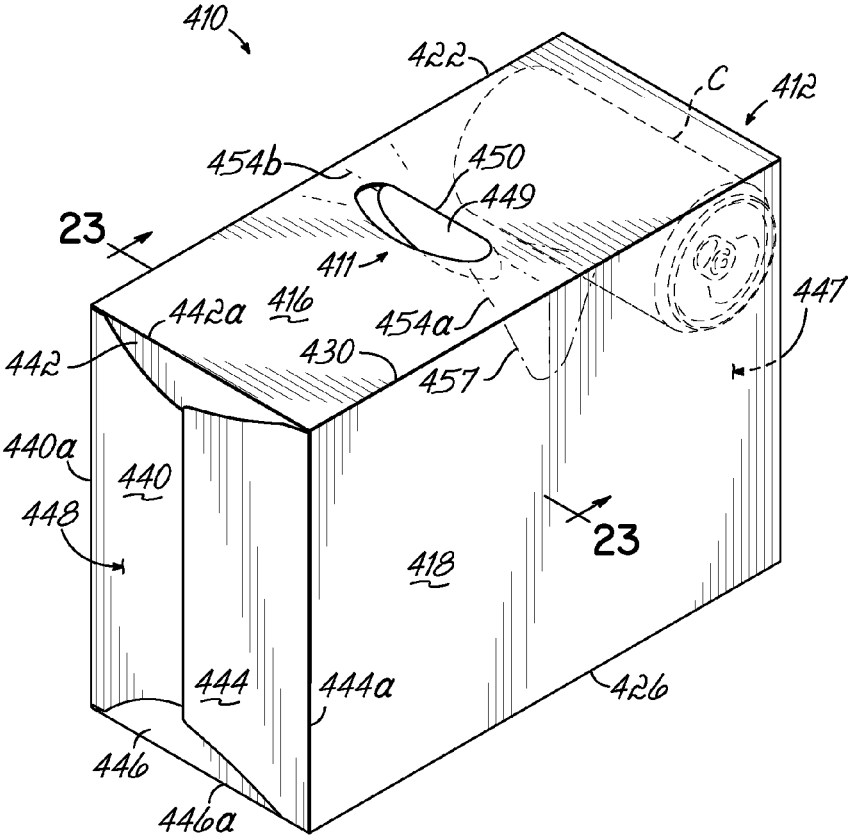

The carton blank and associated carton shown in FIGS. 15-23 are intended to contain twelve cans in a 3×4 arrangement as is well known in the art. Reference numerals 432, 434, 436, 438, 440, 442, 444, 446 designate end flaps foldably connected to the ends of the panels 414, 416, 418, 420. Each end flap is joined to the associated panel 414, 416, 418, 420 by a respective fold line 432*a*, 434*a*, 436*a*, 438*a*, 440*a*, 442*a*, 444*a*, and 446*a*. The end flaps 432, 434, 436, 438 arranged along the upper edge (as viewed in FIG. 15) of the blank 412 form a first composite end wall 447. The ends flaps 440, 442, 444, 446 arranged along the lower edge of FIG. 15 form a second composite end wall 448 as shown in FIG. 22.

FIG. 15 shows a print side of the blank 412; whereas, FIG. 16 shows the opposite face of a non-print side of the blank 412. A carrying handle 411 is formed in the top panel 416 and includes a handle flap 449 joined to a remainder of the panel by a combination of fold and cut lines 450 so that when a user grasps the handle 411, the flap 449 may be folded inwardly toward the non-print side for convenient use.

A pattern 452 of stress-relieving score lines is formed in the blank 412 surrounding the carrying handle 411 in the side panels 414, 418 and the adjacent top panel 416 of the blank 412 of FIGS. 15 and 16. The pattern 452 of stress relieving score lines include score lines 454*a*, 454*b* radiating angularly outward from opposite ends of the carrying handle 411 in the top panel 416. Additional stress relieving score lines 456, 457 are formed adjacent the carrying handle in the side panels 414, 418 respectively, as shown in FIGS. 15 and 16. The purpose of the stress relieving score lines is to distribute the lifting stresses exerted on the carton so that the panels of the carton do not tear, and to control or minimize buckling of the carton when lifted.

As shown in the blank 412 of the embodiment of FIGS. 15-16, a primary reinforcing panel 464 is joined to the glue flap 428 adjacent the side panel 418. A secondary reinforcing panel 466 is joined to a longitudinal distal end of the primary reinforcing panel 464 along a secondary reinforcing panel fold line 468. A cut line 470 is formed between the adjacent edges of the secondary reinforcing panel 466 and the glue flap 428 to permit the secondary reinforcing panel 466 to be pivoted about the secondary reinforcing panel fold line 468 and onto the primary reinforcing panel 464. Line 433 is an extension of cut line 470 to demarcate the glue flap 428 from the panels 464, 466. Handle apertures 472*a*, 472*b* are provided in each of the primary and secondary reinforcing panels 464, 466, respectively, and are mirror images of one another about the secondary reinforcing panel fold line 468 so that when the reinforcing panels 464, 466 are in face-to-face juxtaposition, the respective apertures 472*a*, 472*b* are in alignment and registration.

Additionally, in the primary reinforcing panel 464 is a second pattern of stress relieving score lines 474 which are complimentary to the pattern 452 of stress relieving score lines in the top panel 416. As shown in FIG. 15, the glue lines 476 are provided on the print side of the glue flap 428 as well as on the primary reinforcing panel 464. Additionally, as shown in FIG. 16, glue lines 476 are provided on the non-print side of the secondary reinforcing panel 466 to adhere that panel to the primary reinforcing panel 464. The glue line on the glue flap 426 adheres the glue flap to the top panel 416 adjacent the fold line 430 and the glue lines 476 on the primary reinforcing panel 464 adhere that panel as well as the secondary reinforcing panel 466 to the non-print surface of the top panel 416 containing the carrying handle 411.

Figure 18:
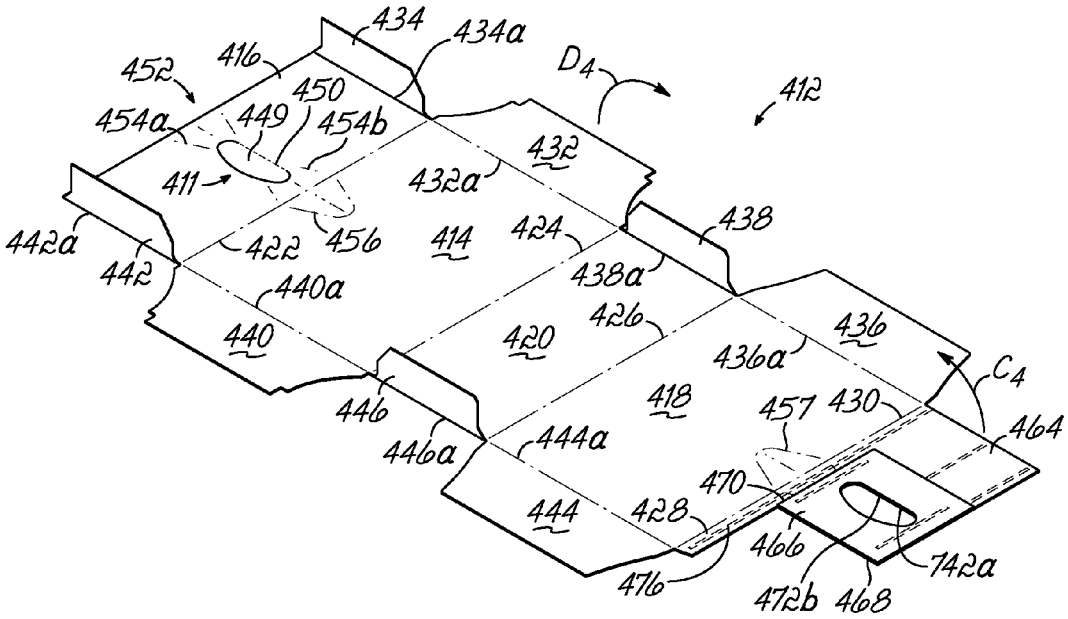

Referring to FIGS. 17-21, to form an erected carton 410 from the blank 412 of FIGS. 15-16, one exemplary sequence begins with folding the secondary reinforcing panel 464 upwardly in the direction of arrow $A_4$ toward the primary reinforcing panel 466 until it is in face-to-face juxtaposition therewith and the handle apertures 472*a*, 472*b* are in registration as shown in FIG. 18. The secondary reinforcing panel 466 is adhered to the primary reinforcing panel 464 by the glue lines. Additionally, the end flaps 442, 446, 434, 438 on the opposite ends of the panels 416, 420 are folded upwardly in the direction of arrows $B_4$ so as to be generally perpendicular to their associated panels.

Referring to FIG. 18, the primary and secondary reinforcing panels 464, 466, as well as the adjoined glue flap 428 are folded upwardly in the direction of arrow $C_4$ so as to be generally perpendicular to the adjacent panel 420. The panels 416, 414 are folded upwardly in the direction of arrow $D_4$ so as to be generally perpendicular to the panel 418 and panel 420.

Figure 19:
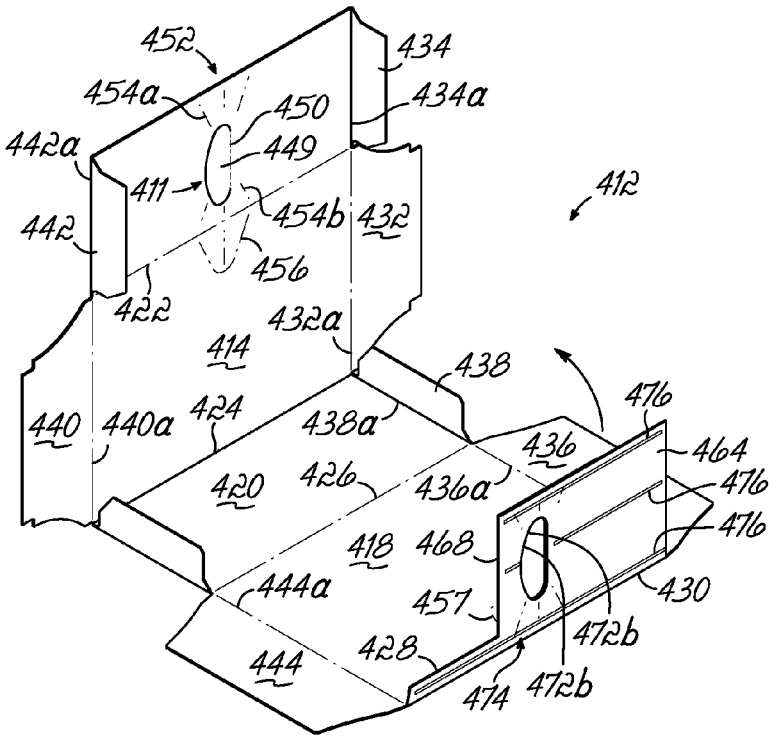
Figure 20:
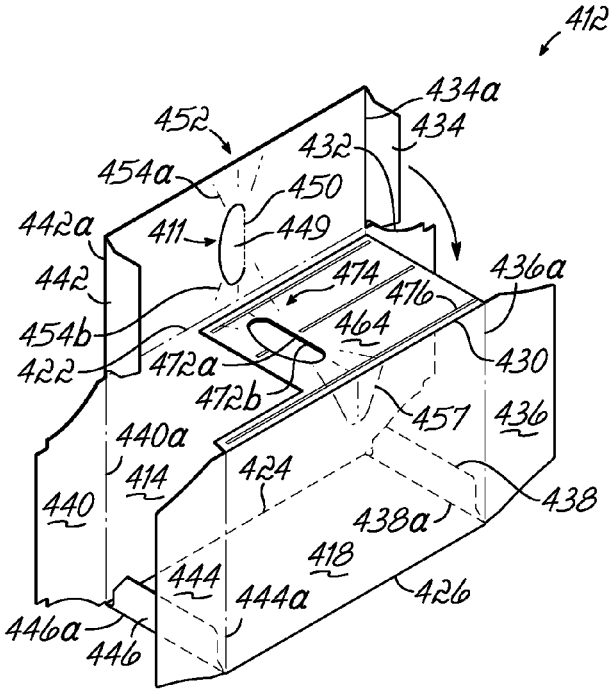
Figure 21:
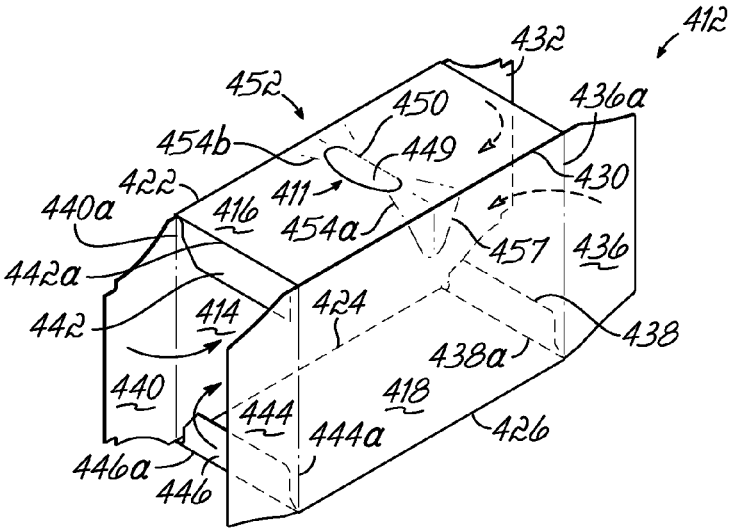

Referring to FIGS. 19-20, panel 416 is folded inwardly so that the primary and secondary reinforcing panels 464, 466 underlie the panel 416 with the handle apertures 472 aligned with the carrying handle 411. The glue lines 476 on the primary reinforcing panel 464 adhere that panel to the non-print side of the panel 416 and the glue lines 476 on the glue flap 428 likewise adhere the glue flap 428 to the non-print side of the panel 416 thereby forming the carton blank 411 into a tubular configuration (FIG. 20). The carton 410 may be in a flat tubular configuration and expanded into an open-ended tubular form into which the containers C are loaded through one or both of the open ends of the carton 410. The end flaps 432, 434, 436, 438, 440, 442, 444, 446 are folded and glued to form the respective end walls to thereby close the ends of the carton 410. To form the end walls, the end flaps 434, 442, 438, 446 are folded to their respective positions generally perpendicular to the associated panel 416, 420. Glue is applied to the outside face of the end flaps 434, 442, 438, 446 to form the composite end walls thereby enclosing the containers C in the carton 410 as shown in FIG. 22. The process steps of erecting the carton blank into a carton may be varied as required for the various applications.

Figure 12:
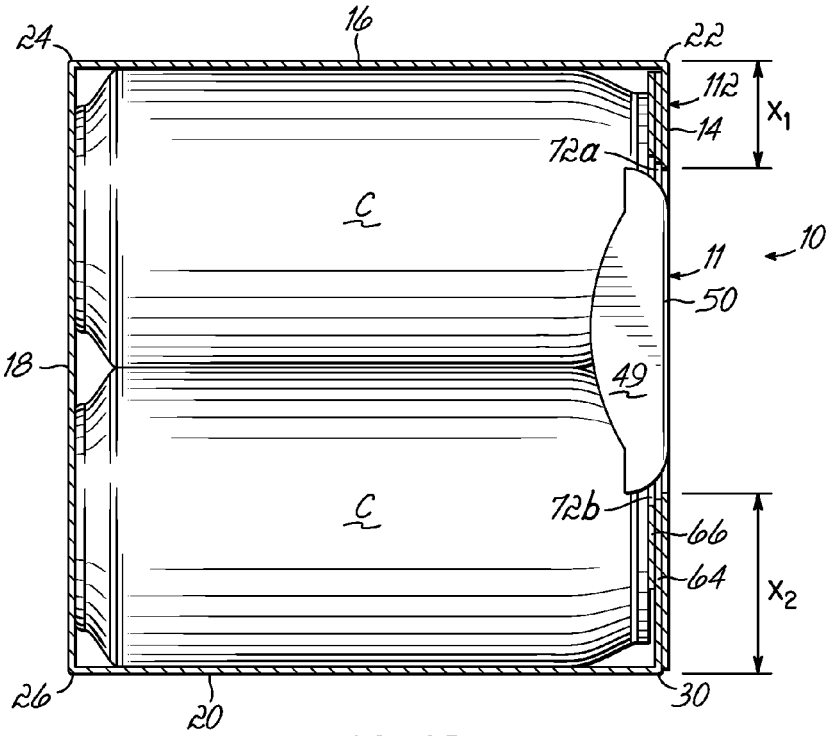
FIG. 12 is a cross-sectional view of the filled carton of FIG. 10 taken along line 12-12 in FIG. 10.
Figure 23:
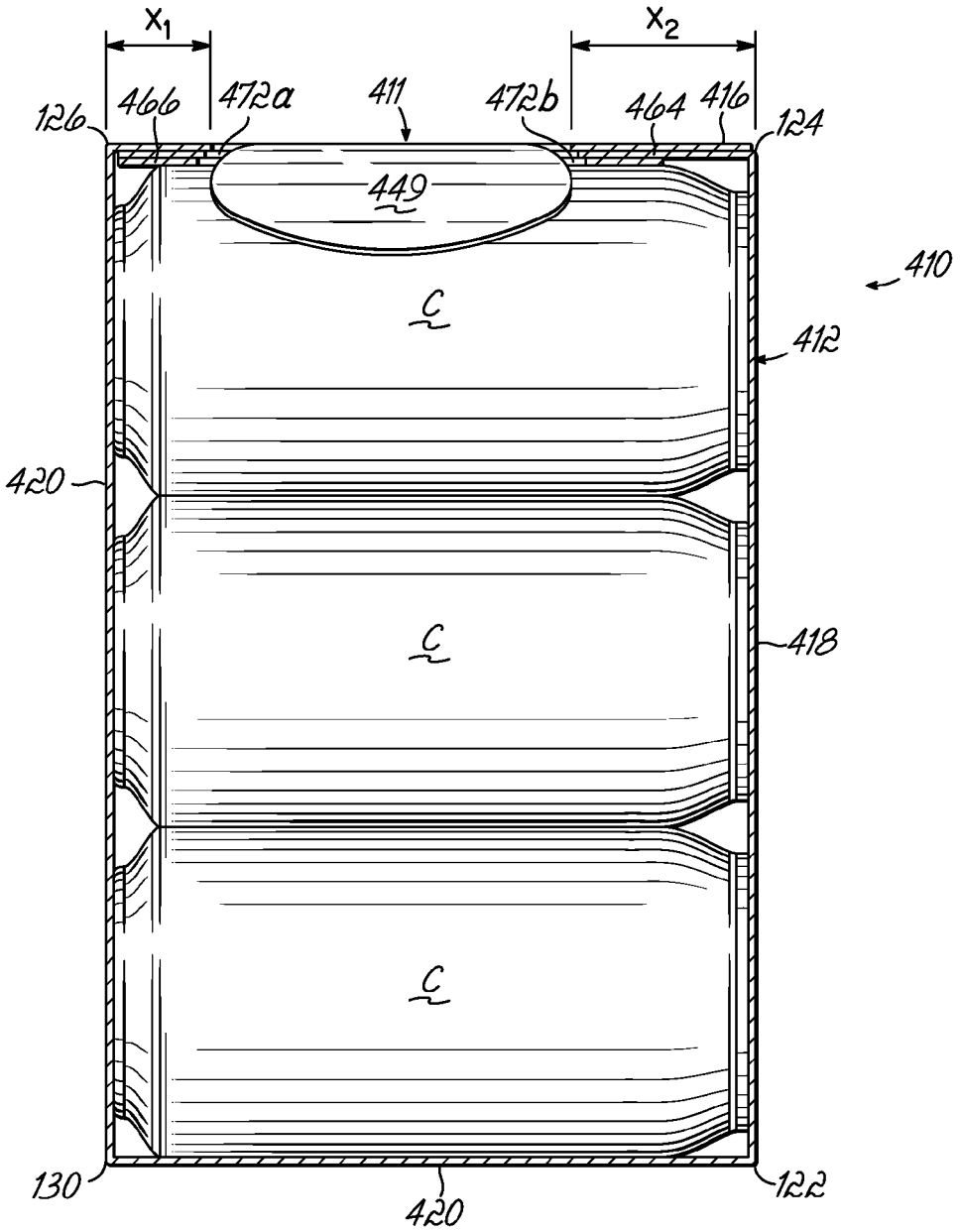

Another feature of various embodiments according to this invention is best shown in FIGS. 12, 14, and 23 where the respective handles 11, 111, and 411 are shown as being positioned laterally off-center on their respective panels. In particular the distance $x_1$ between one end of the handle 11, 111, 411 and the adjacent panel is less than the distance $x_2$ between the opposite end of the handle 11, 111, 411 and the adjacent panel. While this feature is evident in other drawings and embodiments of this invention, it is believed that the inclusion of the reference distance $x_1$ and $x_2$ in FIGS. 12, 14, and 23 demonstrates this feature well. This lateral off-center position of the handle allows for better folding and placement of the various flaps and panels while offering the requisite strength to the reinforced handle.

Figure 24:
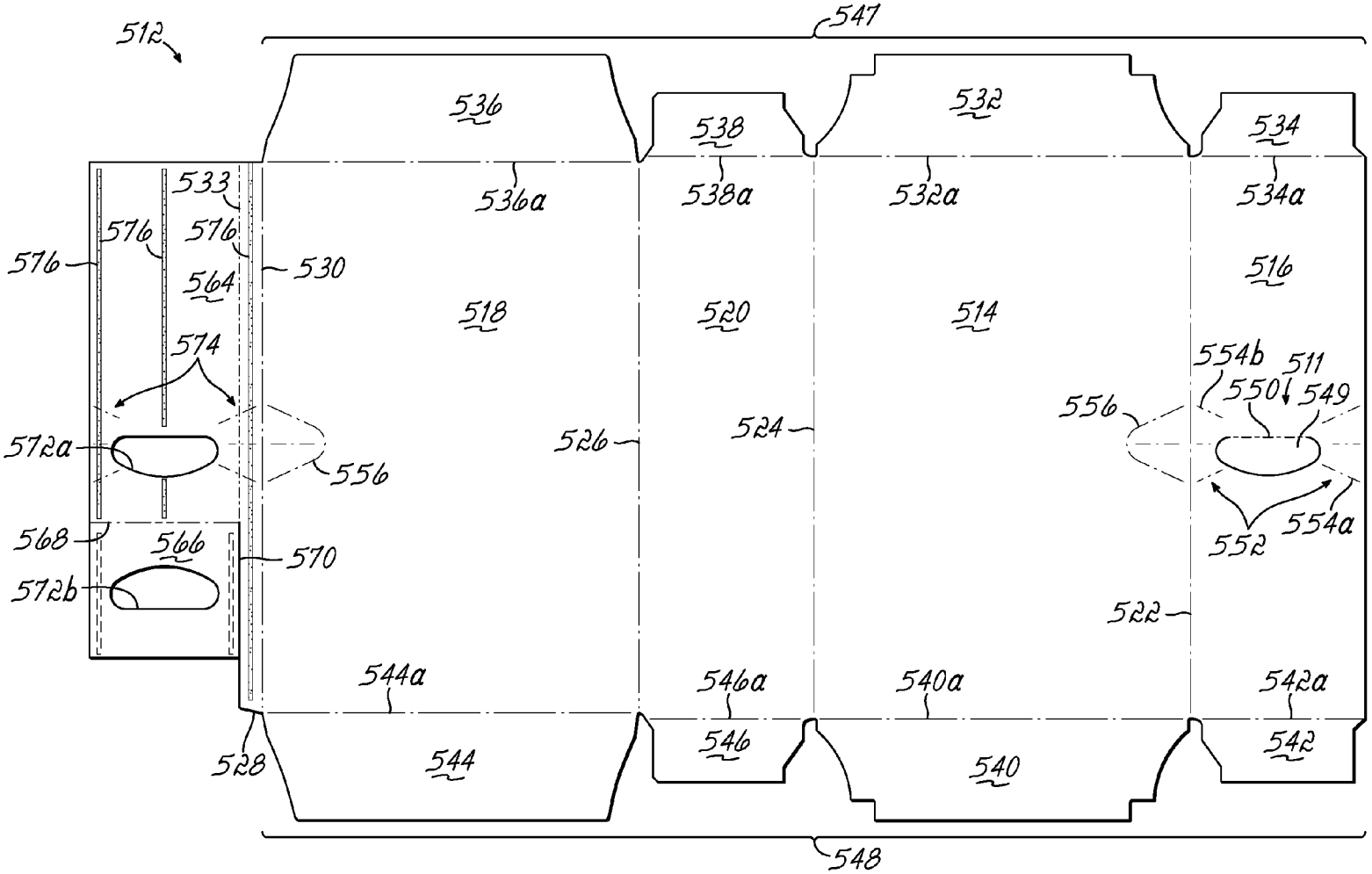
FIGS. 24 and 25 are plan views of a print side and a non-print side, respectively, of a blank used to construct a carton according to another embodiment of this invention.
Figure 25:
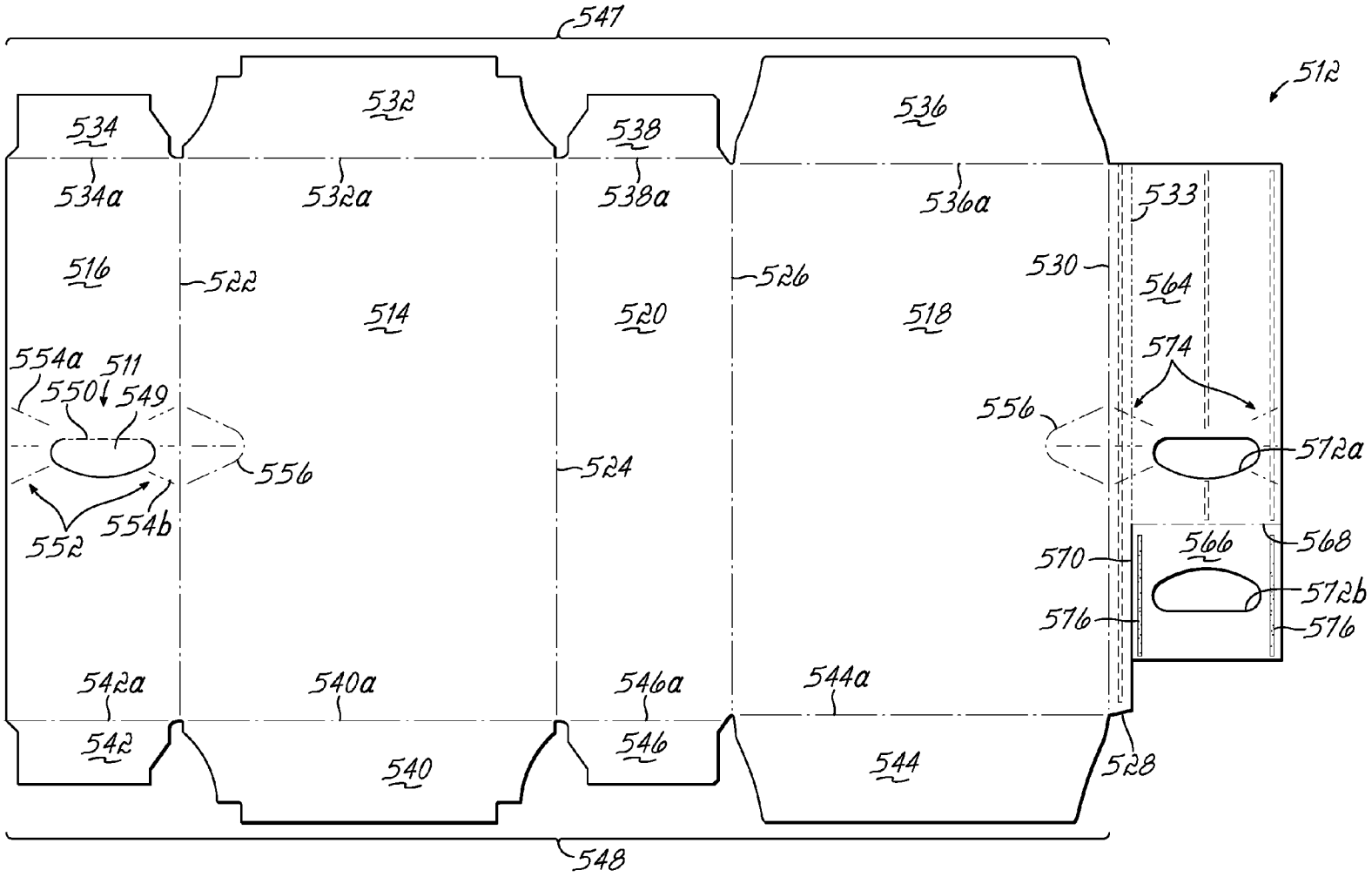

FIGS. 24 and 25 illustrate a blank 512 from which a carton 510 according to another embodiment of this invention is formed. Containers arranged in the carton 510 are in a 4×6 arrangement. The blank 512 includes four primary panels for forming the carton walls, i.e., a first side panel 514, a top panel 516, a second side panel 518 and a bottom panel 520 foldably connected one to the next along fold lines 522, 524, 526. A glue flap 528 is foldably connected to panel 518 along fold line 530. Reference numerals 532, 534, 536, 538, 540, 542, 544, 546 designate end flaps foldably connected the ends of the panels 514, 516, 518, 520, respectively. Each end flap 532, 534, 536, 538, 540, 542, 544, 546 is joined to the associated panel 514, 516, 518, 520 by a fold line 532*a*, 534*a*, 536*a*, 538*a*, 540*a*, 542*a*, 544*a*, 546*a*, respectively. The end flaps 532, 534, 536, 538 arranged along the upper edge (as viewed in FIG. 24) of the blank 512 form a first composite end wall 547. The end flaps 540, 542, 544, 546 arranged along the lower edge of FIG. 24 form a second composite end wall 548.

FIG. 24 shows a print side of the blank 512; whereas, FIG. 25 shows the opposite face of a non-print side of the blank 512. Referring to FIG. 24, a carrying handle 511 is formed in the panel 516 and includes a handle flap 549 joined to a remainder of the panel 514 by a combination of fold and cut lines 550 so that when the user grasps the handle 511, the flap 549 may be folded inwardly toward the non-print side for convenient use.

A pattern 552 of stress-relieving score lines is formed in the blank 512 surrounding the carrying handle 511 in the side panels 514, 518 and the adjacent top panel 516 of the blank 512 of FIGS. 24 and 25. The pattern 552 of stress-relieving score lines includes score lines 554*a*, 554*b* radiating angularly outward from opposite ends of the carrying handle 511 in the side panel 514. Additional stress-relieving score lines 556 are formed adjacent the carrying handle 511 in the top panel 516 as shown in FIGS. 24 and 25. The purpose of the stress relieving score lines 554*a*, 554*b*, 556 is to distribute the lifting stresses exerted on the carton so that the top and side panels of the carton do not tear and control or minimize buckling of the carton when lifted.

As shown in the blank 512 of embodiments of FIGS. 24-25, a primary reinforcing panel 564 is joined to the glue flap 528 adjacent the panel 518. A secondary reinforcing panel 566 is joined to a longitudinal distal end of the primary reinforcing panel 564 along a secondary reinforcing panel fold line 568. A cut line 570 is formed between the adjacent edges of the secondary reinforcing panel 566 and the glue flap 528 to permit the secondary reinforcing panel 566 to be pivoted about the secondary reinforcing panel fold line 568 onto the primary reinforcing panel 564. Line 533 is an extension of cut line 570 to demarcate the glue flap 528 from the panels 564, 566. Handle apertures 572*a*, 572*b* are provided in each of the primary and secondary reinforcing panels 564, 566, respectively, and are mirror images of one another about the secondary reinforcing panel fold line 568 so that when the reinforcing panels 564, 566 are in face-to-face juxtaposition, the respective apertures 572*a*, 572*b* are in alignment and registration.

Additionally, in the primary reinforcing panel 564, a second pattern 574 of stress-relieving score lines is provided which are complimentary to the pattern 552 of stress-relieving score lines in the panels 514, 516, 518.

As shown in FIG. 24, glue lines 576 are provided on the print side of the glue flap 528 as well as on the primary reinforcing panel 564. Additionally, as shown in FIG. 25, glue lines 576 are provided on the non-print side of the secondary reinforcing panel 566 to adhere that panel to the primary reinforcing panel 564. The glue line 576 on the glue flap 528 adheres the glue flap to the top panel 516 adjacent the fold line and the glue lines 576 on the primary reinforcing panel 564 adhere that panel as well as the secondary reinforcing panel 566 to the non-print surface of the top panel 516 containing the carrying handle 511. The glue flap 528 configuration advantageously affords the carton 510 with a well-formed, clean and secure seam when the blank 512 is formed into a tubular configuration and without interference from the reinforcing panels 564, 566. Specifically, since the secondary reinforcing panel 566 is attached to and folded upon the primary reinforcing layer 564, the glue flap 528 which is contiguous with the primary reinforcing layer 564 remains on the same elevation or plane as the primary reinforcing layer 564. In this way when the glue flap 528 is joined to the top panel 516, there is a flat even area (same plane) for the seam while still providing for the multiple ply reinforcing area surrounding the carrying handle 511.

Figure 26:
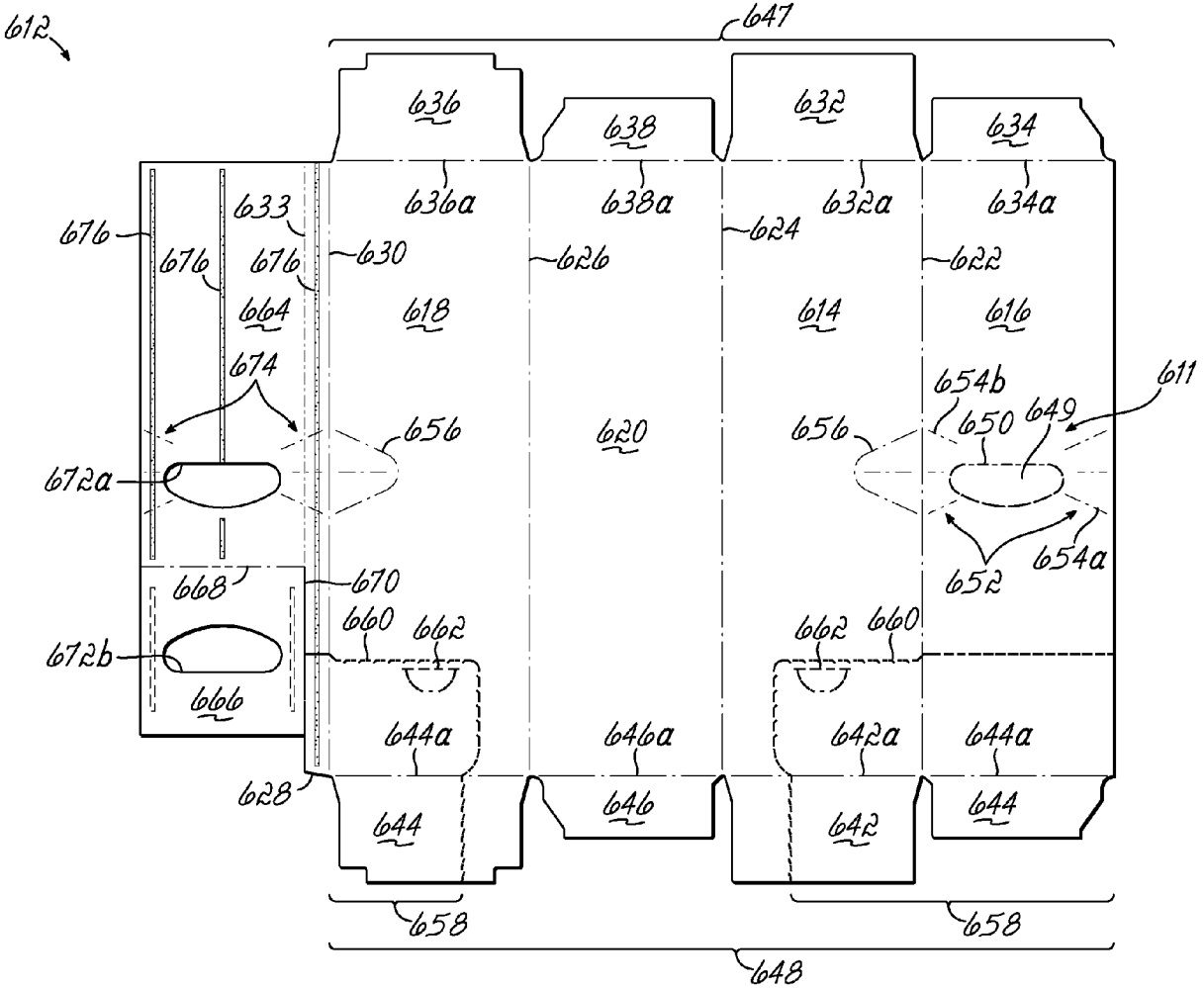
FIGS. 26 and 27 are plan views of a print side and a non-print side, respectively, of a blank used to construct a carton according to another embodiment of this invention.
Figure 27:
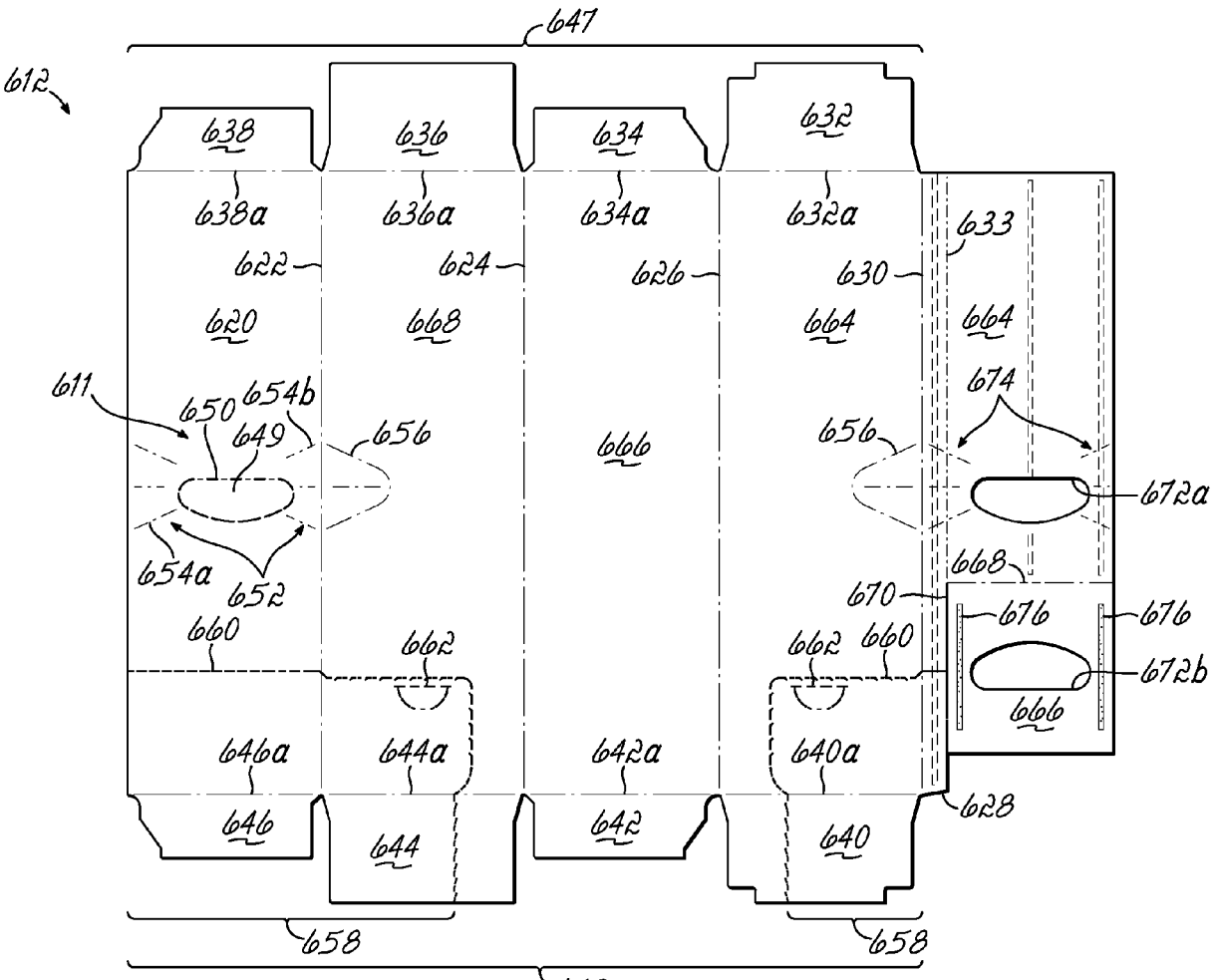

Referring to FIGS. 26 and 27, a further alternative embodiment of a blank 612 for forming a carton according to this invention is shown. The blank 612 of FIGS. 26 and 27 is similar to that shown in FIG. 3A; however, the dispenser 658 of the blank 612 shown in FIGS. 26 and 27 is centered on the top panel 616 containing the handle 611.

Referring to FIGS. 26-27, the blank 612 includes four primary panels for forming the carton walls, i.e., a first side panel 614, a top panel 616, a second side panel 618 and a bottom panel 620 foldably connected one to the next along fold lines 622, 624, 626. A glue flap 628 is foldably connected to panel 618 along fold line 630. Reference numerals 632, 634, 636, 638, 640, 642, 644, 646 designate end flaps foldably connected the ends of the panels 614, 616, 618, 620, respectively. Each end flap 632, 634, 636, 638, 640, 642, 644, 646 is joined to the associated panel 614, 616, 618, 620 by a fold line 632*a*, 634*a*, 636*a*, 638*a*, 640*a*, 642*a*, 644*a*, 646*a*, respectively. The end flaps 632, 634, 636, 638 arranged along the upper edge (as viewed in FIG. 26) of the blank 612 form a first composite end wall 647. The end flaps 640, 642, 644, 646 arranged along the lower edge of FIG. 26 form a second composite end wall 648.

FIG. 26 shows a print side of the blank 612; whereas, FIG. 27 shows the opposite face of a non-print side of the blank 612. Referring to FIG. 26, the carrying handle 611 is formed in the top panel 616 and includes a handle flap 649 joined to a remainder of the panel 614 by a combination of fold and cut lines 650 so that when the user grasps the handle 611, the flap 649 may be folded inwardly toward the non-print side for convenient use.

A pattern 652 of stress-relieving score lines are formed in the blank 612 surrounding the carrying handle 611 in the side panels 614, 618 and the adjacent top panel 616 of the blank 612 of FIGS. 26-27. The pattern 652 of stress-relieving score lines includes score lines 654*a*, 654*b* radiating angularly outward from opposite ends of the carrying handle 611 in the top panel 616. Additional stress-relieving score lines 656 are formed adjacent the carrying handle 611 in the side panel 616 as shown in FIGS. 26 and 27. The purpose of the stress relieving score lines 654*a*, 654*b* and 656 is to distribute the lifting stresses exerted on the carton so that the top and side panels of the carton do not tear and control or minimize buckling of the carton when lifted.

A dispenser 658 is formed from appropriate tear lines 660 and finger holes 662 in the carton blank 612 to provide access to the containers C inside the erected carton 610. The dispenser 658 shown herein is merely an exemplary dispenser and any of a wide variety of dispenser configurations and designs can be utilized with this invention, including the dispenser shown in U.S. Patent Application Publication No. 2004/0089671, assigned to the assignee of this invention and hereby incorporated by reference in its entirety.

As shown in the blank 612 of embodiments of FIGS. 26-27, a primary reinforcing panel 664 is joined to the glue flap 628 adjacent the panel 618. A secondary reinforcing panel 666 is joined to a longitudinal distal end of the primary reinforcing panel 664 along a secondary reinforcing panel fold line 668. A cut line 670 is formed between the adjacent edges of the secondary reinforcing panel 666 and the glue flap 628 to permit the secondary reinforcing panel 666 to be pivoted about the secondary reinforcing panel fold line 668 onto the primary reinforcing panel 664. Line 623 is an extension of cut line 670 to demarcate the glue flap 628 from the panels 664, 666. Handle apertures 672*a*, 672*b* are provided in each of the primary and secondary reinforcing panels 664, 666, respectively, and are mirror images of one another about the secondary reinforcing panel fold line 668 so that when the reinforcing panels 664, 666 are in face-to-face juxtaposition, the respective apertures 672*a*, 672*b* are in alignment and registration.

Additionally, in the primary reinforcing panel 664, a second pattern 674 of stress-relieving score lines is provided which are complimentary to the pattern 652 of stress-relieving score lines in the panel 616. The second pattern 674 of stress-relieving score lines is also included in the adjacent panel 618 of the carton blank 612.

As shown in FIG. 26, glue lines 676 are provided on the print side of the glue flap 628 as well as on the primary reinforcing panel 664. Additionally, as shown in FIG. 27, glue lines 676 are provided on the non-print side of the secondary reinforcing panel 666 to adhere that panel to the primary reinforcing panel 664. The glue line 676 on the glue flap 628 adheres the glue flap to the top panel 616 adjacent the fold line and the glue lines 676 on the primary reinforcing panel 664 adhere that panel as well as the secondary reinforcing panel 666 to the non-print surface of the first side panel 614 containing the carrying handle 611 as will be described later herein. The glue flap 628 configuration advantageously affords the carton 10 with a well-formed, clean and secure seam when the blank 612 is formed into a tubular configuration and without interference from the reinforcing panels 664, 666. Specifically, since the secondary reinforcing panel 666 is attached to and folded upon the primary reinforcing layer 664, the glue flap 628 which is contiguous with the primary reinforcing layer 664 remains on the same elevation or plane as the primary reinforcing layer 664. In this way when the glue flap 628 is joined to the panel 616, there is a flat even area (same plane) for the seam while still providing for the multiple ply reinforcing area surrounding the carrying handle 611.

Figure 28:
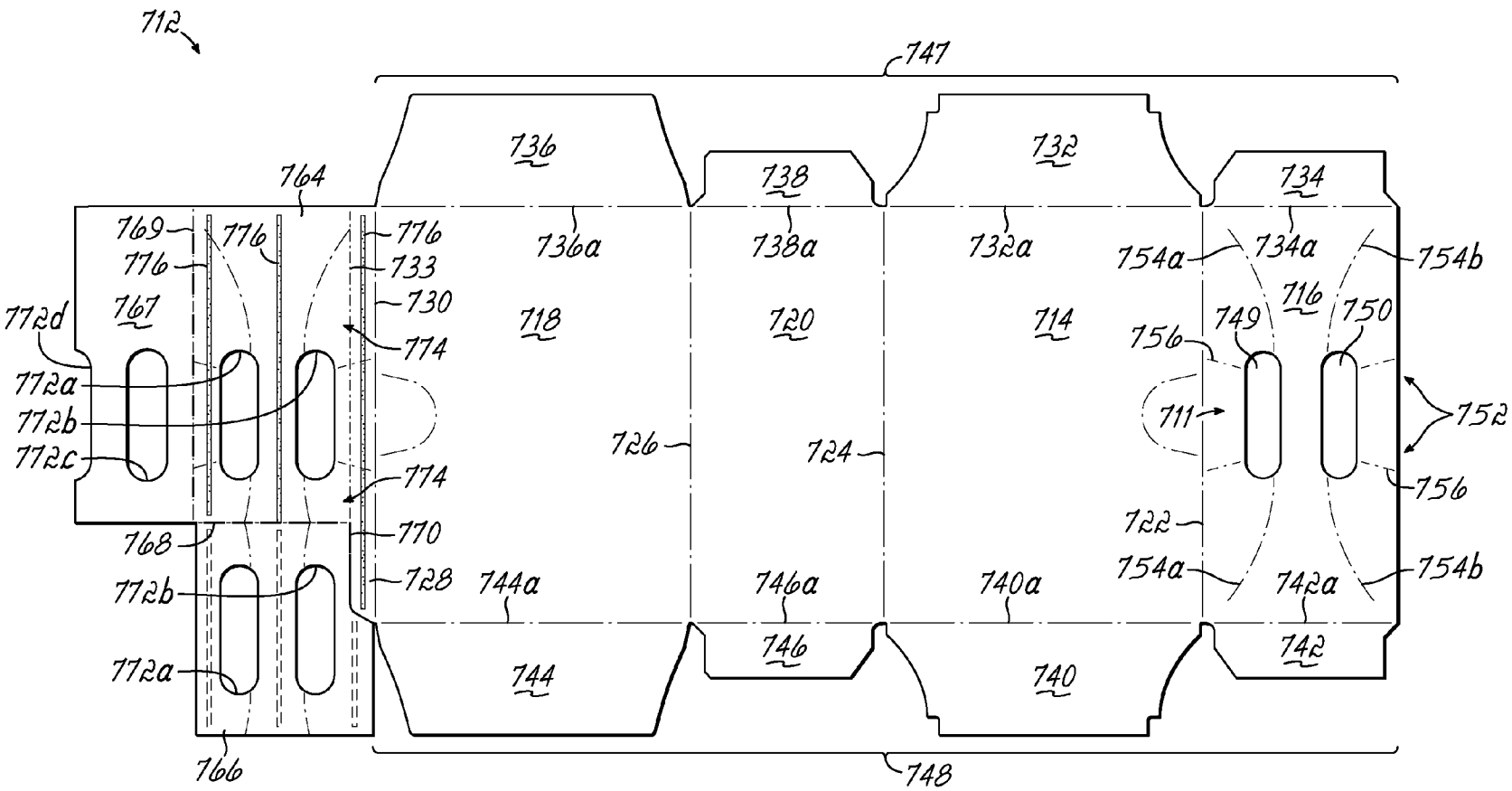
FIGS. 28 and 29 are plan views of a print side and a non-print side, respectively, of a blank used to construct a carton according to another embodiment of this invention.
Figure 29:
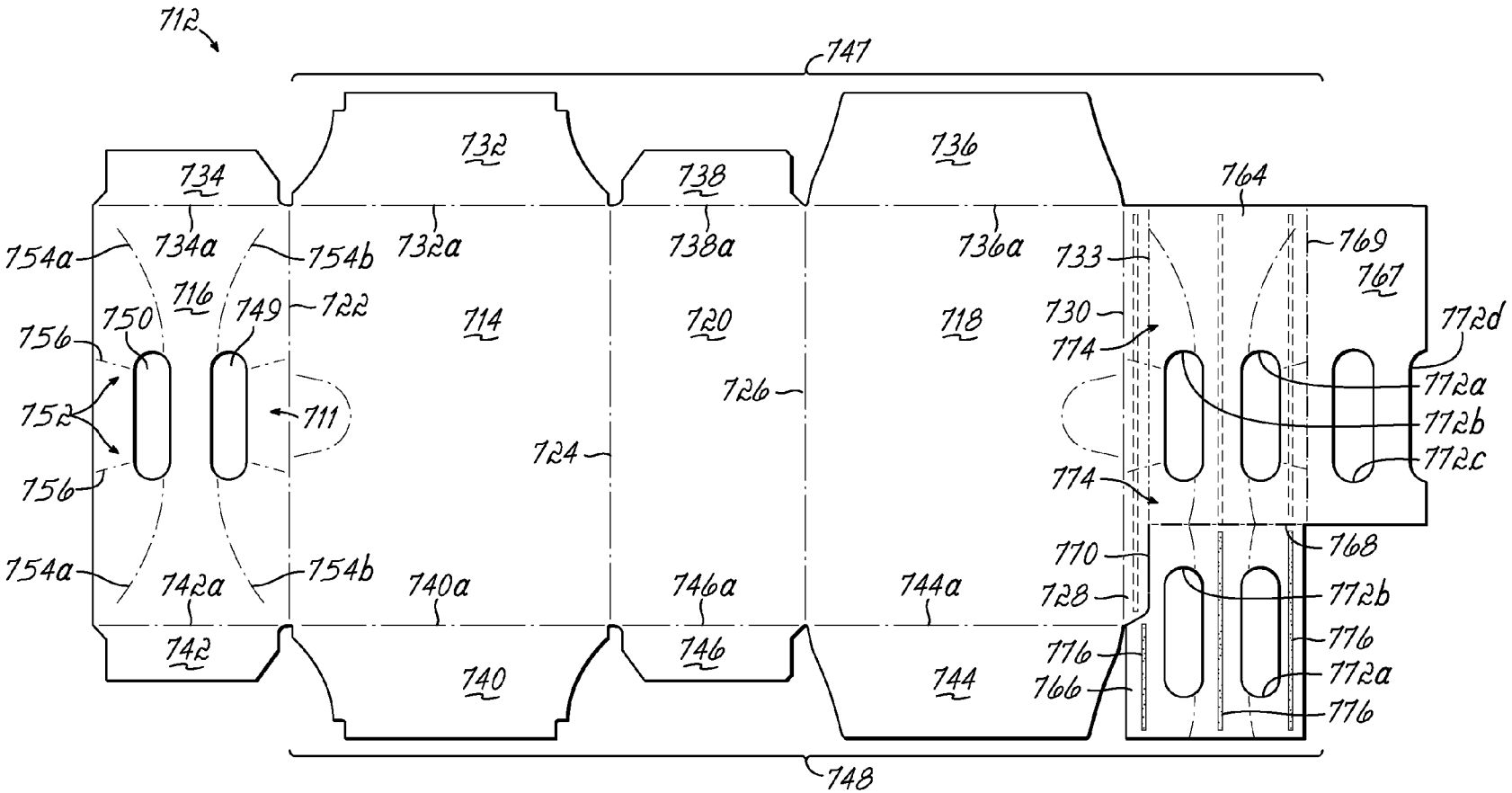

Referring to FIGS. 28 and 29, a blank 712 according to a further alternative embodiment of this invention is shown and can be used to form a carton for containing beverage cans in a 3×4 arrangement. The blank 712 includes four primary panels for forming the carton walls, i.e., a first side panel 714, a top panel 716, a second side panel 718 and a bottom panel 720 foldably connected one to the next along fold lines 722, 724, 726. A glue flap 728 is foldably connected to panel 718 along fold line 730. Reference numerals 732, 734, 736, 738, 740, 742, 744, 746 designate end flaps foldably connected the ends of the panels 714, 716, 718, 720, respectively. Each end flap 732, 734, 736, 738, 740, 742, 744, 746 is joined to the associated panel 714, 716, 718, 720 by a fold line 732*a*, 734*a*, 736*a*, 738*a*, 740*a*, 742*a*, 744*a*, 746*a*, respectively. The end flaps 732, 734, 736, 738 arranged along the upper edge (as viewed in FIG. 28) of the blank 712 form a first composite end wall 747. The end flaps 740, 742, 744, 746 arranged along the lower edge of FIG. 28 form a second composite end wall 748.

FIG. 28 shows a print side of the blank 712; whereas, FIG. 29 shows the opposite face of a non-print side of the blank 712. Referring to FIG. 28, the carrying handle 711 is formed in the top panel 716 and includes two oval cut-outs 749, 750 in a racetrack configuration.

A pattern 752 of stress-relieving score lines are formed in the blank 712 surrounding the carrying handle 711 in the panels 714, 718 and the adjacent top panel 716 of the blank 712 of FIGS. 28-29. The pattern 752 of stress-relieving score lines includes score lines 754*a*, 754*b* radiating longitudinally outward from opposite ends of the carrying handle 711 in the top panel 716. Additional stress-relieving score lines 756 are formed laterally adjacent the carrying handle 711 in the top panel 716 as shown in FIGS. 28-29. The purpose of the stress relieving score lines 754*a*, 754*b* and 756 is to distribute the lifting stresses exerted on the carton so that the top and side panels of the carton do not tear and control or minimize buckling of the carton when lifted.

As shown in the blank 712 of embodiments of FIGS. 28-29, a primary reinforcing panel 764 is joined to the glue flap 728 adjacent the panel 718. A secondary reinforcing panel 766 is joined to a longitudinal distal end of the primary reinforcing panel 764 along a secondary reinforcing panel fold line 768. A cut line 770 is formed between the adjacent edges of the secondary reinforcing panel 766 and the glue flap 728 to permit the secondary reinforcing panel 766 to be pivoted about the secondary reinforcing panel fold line 768 onto the primary reinforcing panel 764. Line 733 is an extension of cut line 770 to demarcate the glue flap 728 from the panels 764, 766. Handle apertures 772*a*, 772*b* are provided in each of the primary and secondary reinforcing panels 764, 766, respectively, and are mirror images of one another about the secondary reinforcing panel fold line 768. Moreover, the embodiment of the blank 712 in FIGS. 28-29 includes a tertiary reinforcing panel 767 joined to the primary reinforcing panel 764 along fold line 769 and includes a handle aperture 772*c* and a handle notch 772*d*. When the reinforcing panels 764, 766, 767 are in face-to-face juxtaposition, the respective apertures 772*a*, 772*b*, 772*c*, 772*d* are in alignment and registration.

Additionally, in the primary reinforcing panel 764, a second pattern 74 of stress-relieving score lines is provided which are complimentary to the pattern 752 of stress-relieving score lines in the top panel 716. The second pattern 774 of stress-relieving score lines is also included in the adjacent panel 718 of the carton blank 712.

As shown in FIG. 28, glue lines 776 are provided on the print side of the glue flap 728 as well as on the primary reinforcing panel 764. Additionally, as shown in FIG. 29, glue lines 776 are provided on the non-print side of the secondary reinforcing panel 766 to sandwich the tertiary reinforcing panel 767 between to the primary reinforcing panel 764 and the secondary reinforcing panel 766. The glue line 776 on the glue flap 728 adheres the glue flap to the top panel 716 adjacent the fold line and the glue lines 776 on the primary reinforcing panel 764 adhere that panel as well as the secondary and tertiary reinforcing panels 766, 767 to the non-print surface of the panel 716 containing the carrying handle 711. The glue flap 728 configuration advantageously affords the carton 710 with a well-formed, clean and secure seam when the blank 712 is formed into a tubular configuration and without interference from the reinforcing panels 764, 766, 767. Specifically, since the secondary and tertiary reinforcing panels 766, 767 are attached to and folded upon the primary reinforcing panel 764, the glue flap 728 which is contiguous with the primary reinforcing layer 764 remains on the same elevation or plane as the primary reinforcing panel 764. In this way when the glue flap 728 is joined to the top panel 716, there is a flat even area (same plane) for the seam while still providing for the multiple ply reinforcing area surrounding the carrying handle 711, which in this embodiment is four plies thick (i.e., panels 716, 764, 766, 767).

Figure 30:
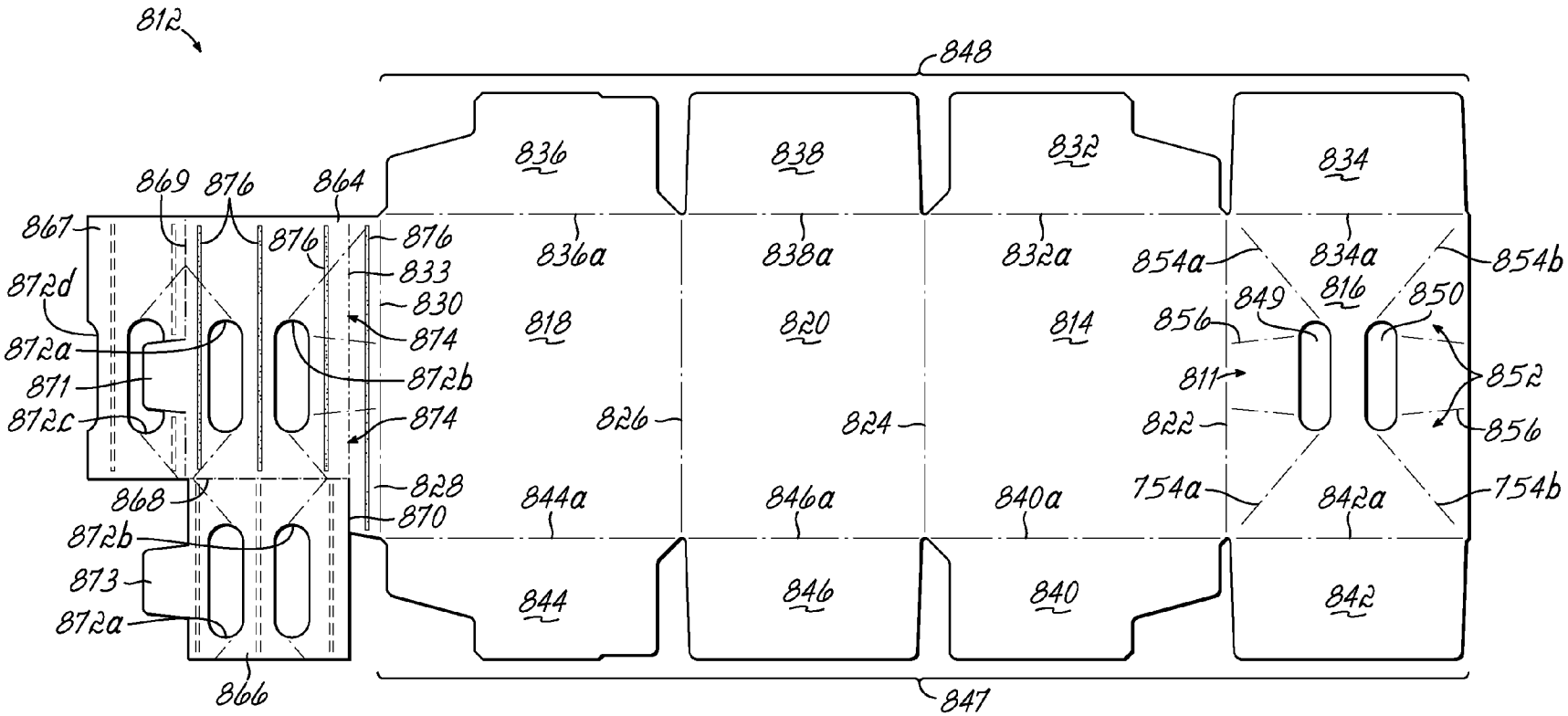
FIGS. 30 and 31 are plan views of a print side and a non-print side, respectively, of a blank used to construct a carton according to another embodiment of this invention.
Figure 31:
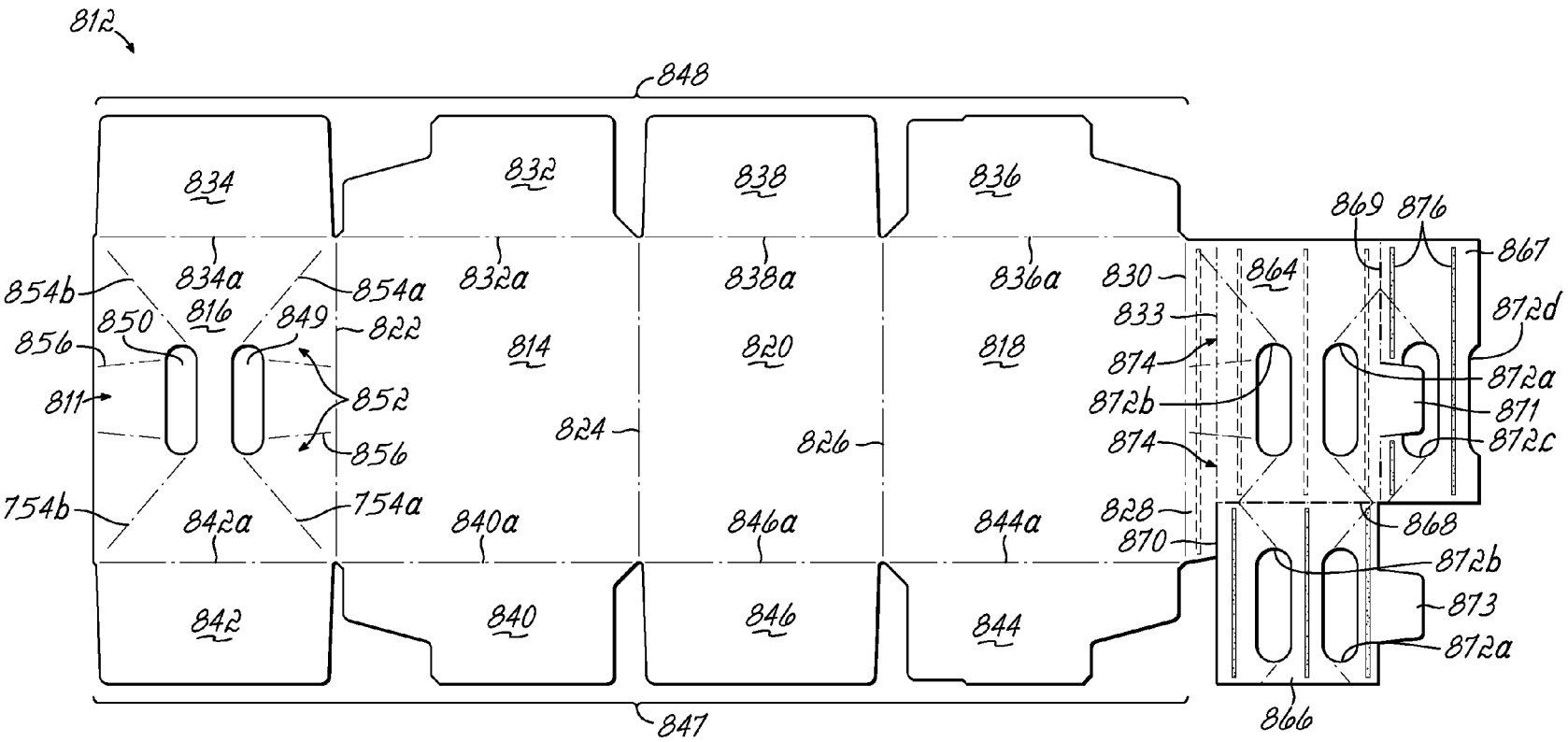

Referring to FIGS. 30 and 31, the blank 812 according to a still further embodiment of this invention is shown forming a carton to contain beverage cans arranged in a 3×4 matrix with two layers of cans. As a result, a carton formed from the blank of FIGS. 30 and 31 would contain 24 beverage cans. The blank 812 includes four primary panels for forming the carton walls, i.e., a first side panel 814, a top panel 816, a second side panel 818 and a bottom panel 820 foldably connected one to the next along fold lines 822, 824, 826. A glue flap 828 is foldably connected to panel 818 along fold line 830. Reference numerals 832, 834, 836, 838, 840, 842, 844, 846 designate end flaps foldably connected the ends of the panels 814, 816, 818, 820, respectively. Each end flap 832, 834, 836, 838, 840, 842, 844, 846 is joined to the associated panel 814, 816, 818, 820 by a fold line 832*a*, 834*a*, 836*a*, 838*a*, 840*a*, 842*a*, 844*a*, 846*a*, respectively. The end flaps 832, 834, 836, 838 arranged along the upper edge (as viewed in FIG. 30) of the blank 812 form a first composite end wall 847. The end flaps 840, 842, 844, 846 arranged along the lower edge of FIG. 30 form a second composite end wall 848.

FIG. 30 shows a print side of the blank 812; whereas, FIG. 31 shows the opposite face of a non-print side of the blank 812. Referring to FIG. 30, the carrying handle 811 is formed in the top panel 816 and includes two cut outs 849, 850 in a racetrack configuration.

A pattern 852 of stress-relieving score lines are formed in the blank 812 surrounding the carrying handle 811 in the top panel 816 and the adjacent side panel 814 of the blank 812 of FIGS. 30-31. The pattern 852 of stress-relieving score lines includes score lines 854*a*, 854*b* radiating angularly outward from opposite ends of the carrying handle 811 in the top panel 814. Additional stress-relieving score lines 856 are formed laterally adjacent the carrying handle 811 in the top panel 816 as shown in FIGS. 30-31. The purpose of the stress relieving score lines 854*a*, 854*b*, 856 is to distribute the lifting stresses exerted on the carton so that the top and side panels of the carton do not tear and control or minimize buckling of the carton when lifted.

As shown in the blank 812 of embodiments of FIGS. 30-31, a primary reinforcing panel 864 is joined to the glue flap 828 adjacent the side panel 818. A secondary reinforcing panel 866 is joined to a longitudinal distal end of the primary reinforcing panel 864 along a secondary reinforcing panel fold line 868. A cut line 870 is formed between the adjacent edges of the secondary reinforcing panel 866 and the glue flap 828 to permit the secondary reinforcing panel 866 to be pivoted about the secondary reinforcing panel fold line 868 onto the primary reinforcing panel 864. Line 833 is an extension of cut line 870 to demarcate the glue flap 828 from the panels 864, 866. Handle apertures 872*a*, 872*b* are provided in each of the primary and secondary reinforcing panels 864, 866, respectively, and are mirror images of one another about the secondary reinforcing panel fold line 868. Moreover, the embodiment of the blank 812 in FIGS. 30-31 includes a tertiary reinforcing panel 867 joined to the primary reinforcing panel 864 along fold line 869 and includes a handle aperture 872*c* and a handle notch 872*d*. When the reinforcing panels 864, 866, 867 are in face-to-face juxtaposition, the respective apertures 872*a*, 872*b*, 872*c*, 872*d* are in alignment and registration. The primary and secondary reinforcing panels 864, 866 each include a lateral extending tab 871, 873, respectively, to offer more support and strength to the multiply handle area.

Additionally, in the primary reinforcing panel 864, a second pattern 874 of stress-relieving score lines is provided which are complimentary to the pattern 852 of stress-relieving score lines in the top panel 816. The second pattern 874 of stress-relieving score lines is also included in the adjacent panel 818, 820 of the carton blank 812.

As shown in FIG. 30, glue lines 876 are provided on the print side of the glue flap 828 as well as on the primary reinforcing panel 864. Additionally, as shown in FIG. 31, glue lines 876 are provided on the non-print side of the secondary reinforcing panel 866 to sandwich the tertiary reinforcing panel 867 between the primary reinforcing panel 864 and the secondary reinforcing panel 866. The glue line 876 on the glue flap 828 adheres the glue flap to the top panel 816 adjacent the fold line and the glue lines 876 on the primary reinforcing panel 864 adhere that panel as well as the secondary and tertiary reinforcing panels 866, 867 to the non-print surface of the top panel 816 containing the carrying handle 811. The glue flap 828 configuration advantageously affords the carton 810 with a well-formed, clean and secure seam when the blank 812 is formed into a tubular configuration and without interference from the reinforcing panels 864, 866, 867. Specifically, since the secondary and tertiary reinforcing panels 866, 867 are attached to and folded upon the primary reinforcing layer 864, the glue flap 828 which is contiguous with the primary reinforcing layer 64 remains on the same elevation or plane as the primary reinforcing layer 864. In this way when the glue flap 828 is joined to the panel 816, there is a flat even area (same plane) for the seam while still providing for the multiple ply reinforcing area surrounding the carrying handle 811, which in this embodiment is four plies thick (i.e., panels 816, 864, 866, 867).

Figure 32:
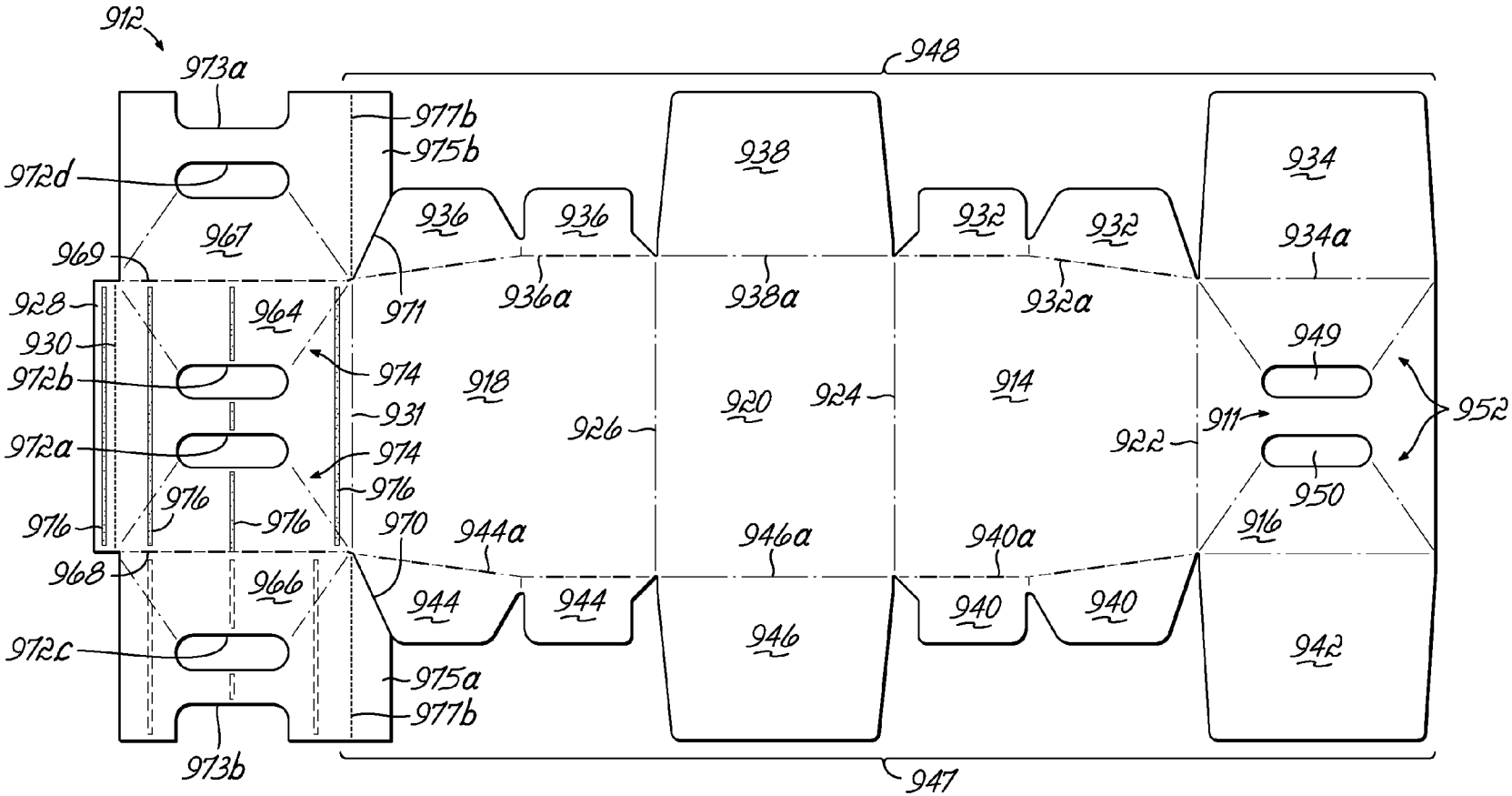
FIGS. 32 and 33 are plan views of a print side and a non-print side, respectively, of a blank used to construct a carton according to another embodiment of this invention.
Figure 33:
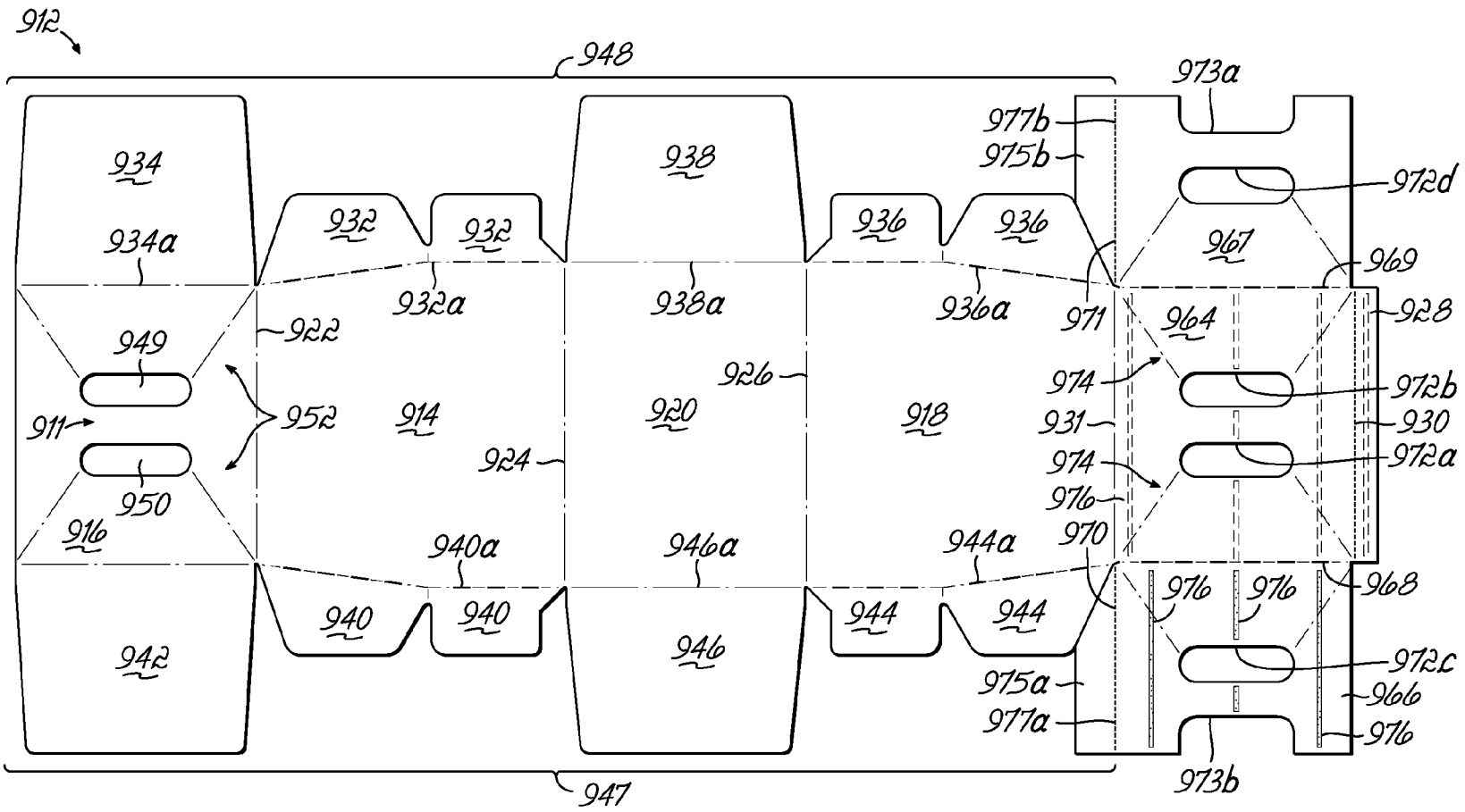

Referring to FIGS. 32 and 33, a still further alternative embodiment of a blank 912 according to this invention is shown. This blank 912 is used to construct a carton to contain bottles arranged in a 3×4 matrix and oriented vertically when the bottom of the carton is supported on an underlying surface. The blank 912 includes four primary panels for forming the carton walls, i.e., a first side panel 914, a top panel 916, a second side panel 918 and a bottom panel 920 foldably connected one to the next along fold lines 922, 924, 926. A glue flap 928 is foldably connected to a primary reinforcing panel 964 along fold line 930. Fold line 931 joins side panel 918 to the primary reinforcing panel 964. Reference numerals 932, 934, 936, 938, 940, 942, 944, 946 designate end flaps foldably connected the ends of the panels 914, 916, 918, 20, respectively. Each end flap 932, 934, 936, 938, 940, 942, 944, 946 is joined to the associated panel 914, 916, 918, 920 by a fold line 932*a*, 934*a*, 936*a*, 938*a*, 940*a*, 942*a*, 944*a*, 946*a*, respectively. The end flaps 932, 934, 936, 938 arranged along the upper edge (as viewed in FIG. 32) of the blank 912 form a first composite end wall 947. The end flaps 940, 942, 944, 946 arranged along the lower edge of FIG. 32 form a second composite end wall 948 as shown in FIG. 10.

FIG. 32 shows a print side of the blank 912; whereas, FIG. 33 shows the opposite face of a non-print side of the blank 912. Referring to FIG. 32, the carrying handle 911 is formed in the top panel 916 and includes a pair of transversely oriented cut-outs 949, 950 in a racetrack configuration.

A pattern 952 of stress-relieving score lines are formed in the blank 912 surrounding the carrying handle 911 in the top panel 916. The pattern 952 of stress-relieving score lines includes score lines radiating angularly outward from opposite ends of the carrying handle 911 in the panel 916. The purpose of the stress relieving score lines is to distribute the lifting stresses exerted on the carton so that the top panel of the carton does not tear and to control or minimize buckling of the carton when lifted.

As shown in the blank 912 of embodiments of FIGS. 32-33, a primary reinforcing panel 964 is joined between the glue flap 928 and the side panel 920. A secondary reinforcing panel 966 is joined to a first longitudinal end of the primary reinforcing panel 964 along a secondary reinforcing panel fold line 968. A cut line 970 is formed between the adjacent edges of the secondary reinforcing panel 966 and the flap 944 to permit the secondary reinforcing panel 966 to be pivoted about the secondary reinforcing panel fold line 968 onto the primary reinforcing panel 964. A tertiary reinforcing panel 967 is joined to a second, opposite longitudinal end of the primary reinforcing panel 964 along a tertiary reinforcing panel fold line 969. A cut line 971 is between the panel 967 and flap 936 to permit folding of the panel 967. Handle apertures 972*a*, 972*b*, 972*c*, 972*d* are provided in each of the primary, secondary and tertiary reinforcing panels 964, 966, 967, respectively, and are mirror images of one another about the fold line 968, 969 so that when the reinforcing panels 964, 966, 967 are in face-to-face juxtaposition, the respective apertures 972*a*, 972*b*, 972*c*, 972*d* are in alignment and registration. Handle notches 973*a*, 973*b* are formed in the terminal edges of panels 966, 967. Panels 966 and 967 each include an extension 975*a*, 975*b*, respectively, joined to the respective panel by a fold line 977*a*, 977*b*.

Additionally, in the primary reinforcing panel 964, a second pattern 74 of stress-relieving score lines is provided which are complimentary to the pattern 52 of stress-relieving score lines in the top panel 916. The second pattern 74 of stress-relieving score lines is also included in the adjacent panels 966, 967 of the carton blank 912.

As shown in FIG. 32, glue lines 976 are provided on the print side of the glue flap 928 as well as on the primary reinforcing panel 964. Additionally, as shown in FIG. 33, glue lines 976 are provided on the non-print side of the secondary and tertiary reinforcing panels 966, 967 to adhere those panels to the primary reinforcing panel 964. The glue line 976 on the glue flap 928 adheres the glue flap to the side panel 914 adjacent the fold line 922 and the glue lines 976 on the primary reinforcing panel 964 adhere that panel as well as the secondary and tertiary reinforcing panels 966, 967 to the non-print surface of the top panel 916 containing the carrying handle 911. The glue flap 928 configuration advantageously affords the carton 910 with a well-formed, clean and secure seam when the blank 912 is formed into a tubular configuration and without interference from the reinforcing panels 964, 966, 967. The carton of this embodiment has a four-ply thickness supporting the handle 911.

Figure 34:
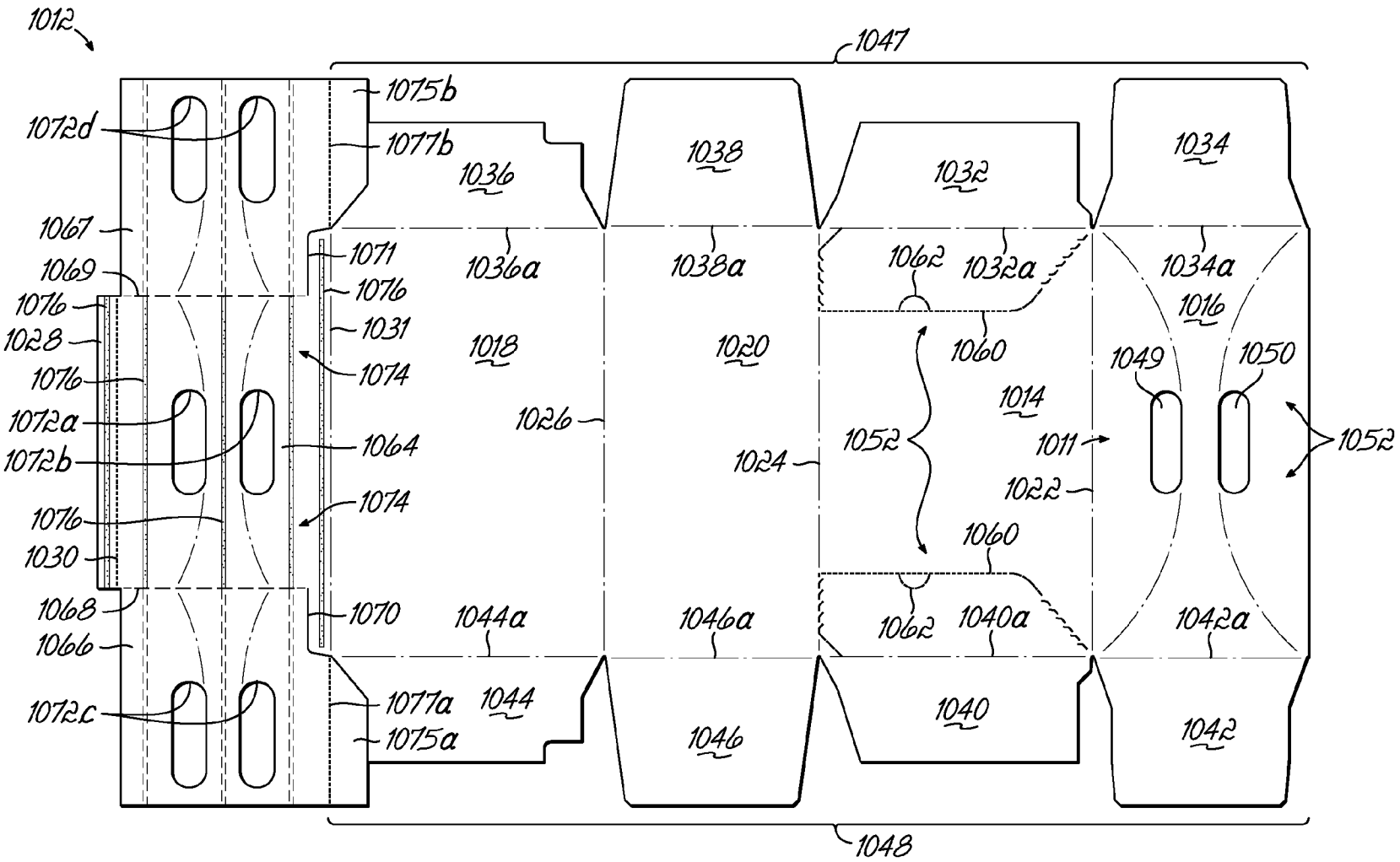
FIGS. 34 and 35 are plan views of a print side and a non-print side, respectively, of a blank used to construct a carton according to another embodiment of this invention.
Figure 35:
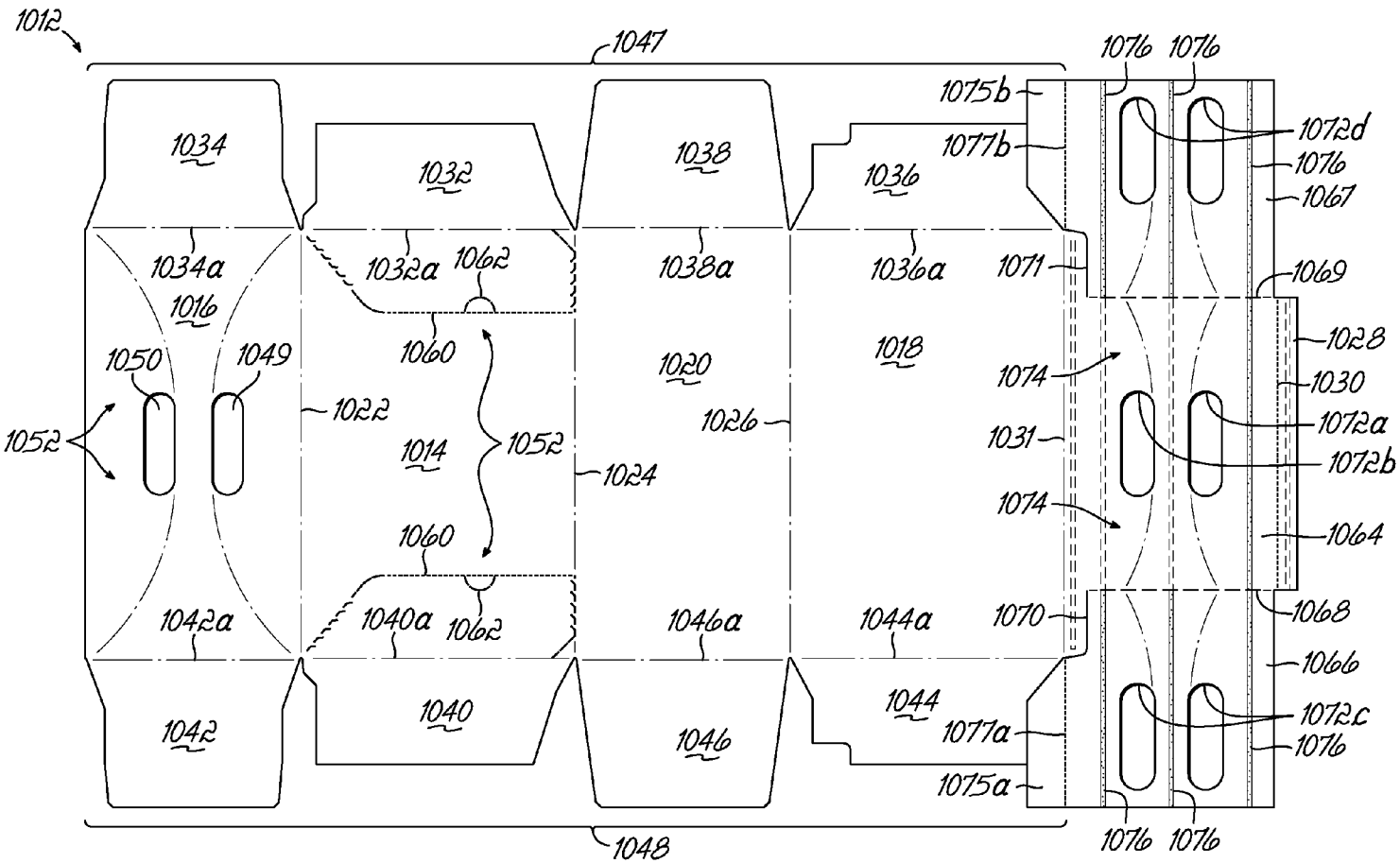

Referring to FIGS. 34 and 35, another alternative embodiment of a carton blank 1012 used to form a carton according to one embodiment of this invention is shown. The carton formed from the blank of FIGS. 34 and 35 is intended to contain bottles arranged in a 3×6 matrix. This blank 1012 is used to construct a carton to contain bottles arranged in a 3×6 matrix and oriented vertically when the bottom of a carton is supported on an underlying surface.

The blank 1012 includes four primary panels for forming the carton walls, i.e., a first side panel 1014, a top panel 1016, a second side panel 1018 and a bottom panel 1020 foldably connected one to the next along fold lines 1022, 1024, 1026. A glue flap 1028 is foldably connected to a primary reinforcing panel 1064 along fold line 1030. Fold line 1031 joins side panel 1018 to the primary reinforcing panel 1064. Reference numerals 1032, 1034, 1036, 1038, 1040, 1042, 1044, 1046 designate end flaps foldably connected the ends of the panels 1014, 1016, 1018, 1020, respectively. Each end flap 1032, 1034, 1036, 1038, 1040, 1042, 1044, 1046 is joined to the associated panel 1014, 1016, 1018, 1020 by a fold line 1032*a*, 1034*a*, 1036*a*, 1038*a*, 1040*a*, 1042*a*, 1044*a*, 1046*a*, respectively. The end flaps 1032, 1034, 1036, 1038 arranged along the upper edge (as viewed in FIG. 34) of the blank 1012 form a first composite end wall 1047. The end flaps 1040, 1042, 1044, 1046 arranged along the lower edge of FIG. 34 form a second composite end wall 1048.

FIG. 34 shows a print side of the blank 1012; whereas, FIG. 35 shows the opposite face of a non-print side of the blank 1012. Referring to FIG. 34, the carrying handle 1011 is formed in the top panel 1016 and includes a pair of transversely oriented cut-outs 1049, 1050 in a racetrack configuration.

A pattern 1052 of stress-relieving score lines is formed in the blank 1012 surrounding the carrying handle 1011 in the top panel 1016. The pattern 1052 of stress-relieving score lines includes score lines radiating angularly outward from opposite ends of the carrying handle 1011 in the panel 1016. The purpose of the stress relieving score lines is to distribute the lifting stresses exerted on the carton so that the top panel 1016 of the carton does not tear and to control or minimize buckling of the carton when lifted.

A dispenser 1058 is formed from appropriate tear lines 1060 and finger holes 1062 in the carton blank 1012 to provide access to the containers C inside the erected carton. The dispenser 1058 shown herein is merely an exemplary dispenser and any of a wide variety of dispenser configurations and designs container be utilized with this invention.

As shown in the blank 1012 of embodiments of FIGS. 34-35, a primary reinforcing panel 1064 is joined between the glue flap 1028 and the side panel 1018. A secondary reinforcing panel 1066 is joined to a first longitudinal end of the primary reinforcing panel 1064 along a secondary reinforcing panel fold line 1068. A cut line 1070 is formed between the adjacent edges of the secondary reinforcing panel 1066 and the flap 1044 to permit the secondary reinforcing panel 1066 to be pivoted about the secondary reinforcing panel fold line 1068 onto the primary reinforcing panel 1064. A tertiary reinforcing panel 1067 is joined to a second, opposite longitudinal end of the primary reinforcing panel 1064 along a tertiary reinforcing panel fold line 1069. A cut line 1071 is between the panel 1067 and flap 1036 to permit folding of the panel 1067. Handle apertures 1072*a*, 1072*b*, 1072*c*, 1072*d* are provided in each of the primary, secondary and tertiary reinforcing panels 1064, 1066, 1067, respectively, and are mirror images of one another about the fold lines 1068, 1069 so that when the reinforcing panels 1064, 1066, 1067 are in face-to-face juxtaposition, the respective apertures 1072*a*, 1072*b*, 1072*c*, 1072*d* are in alignment and registration. Panels 1066 and 1067 each include an extension 1075*a*, 1075*b*, respectively, joined to the respective panel by a fold line 1077*a*, 1077*b*.

Additionally, in the primary reinforcing panel 1064, a second pattern 1074 of stress-relieving score lines is provided which is complimentary to the pattern 1052 of stress-relieving score lines in the top panel 1016. The second pattern 1074 of stress-relieving score lines extends into the adjacent panels 1066, 1067 of the carton blank 1012.

As shown in FIG. 34, glue lines 1076 are provided on the print side of the glue flap 1028 as well as on the primary reinforcing panel 1064. Additionally, as shown in FIG. 35, glue lines 1076 are provided on the non-print side of the secondary and tertiary reinforcing panels 1066, 1067 to adhere those panels to the primary reinforcing panel 1064. The glue line 1076 on the glue flap 1028 adheres the glue flap to the side panel 1014 adjacent the fold line 1022 and the glue lines 1076 on the primary reinforcing panel 1064 adhere that panel as well as the secondary and tertiary reinforcing panels 1066, 1067 to the non-print surface of the top panel 1016 containing the carrying handle 1011. The glue flap 1028 configuration advantageously affords the carton 1010 with a well-formed, clean and secure seam when the blank 1012 is formed into a tubular configuration and without interference from the reinforcing panels 1064, 1066, 1067. The carton of this embodiment has a four-ply thickness supporting the handle 1011.

Figure 36:
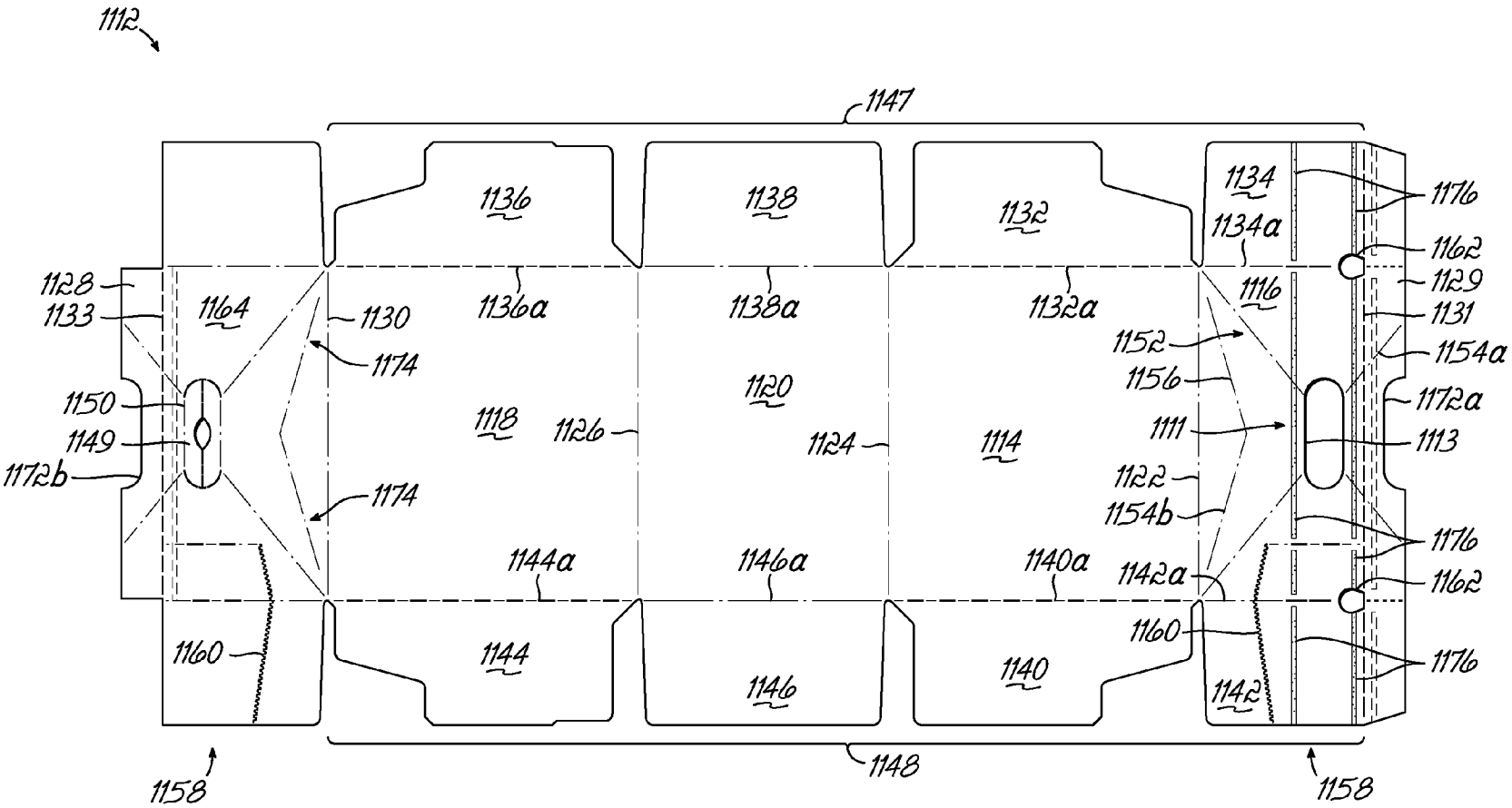
FIGS. 36 and 37 are plan views of a print side and a non-print side, respectively, of a blank used to construct a carton according to another embodiment of this invention.
Figure 37:
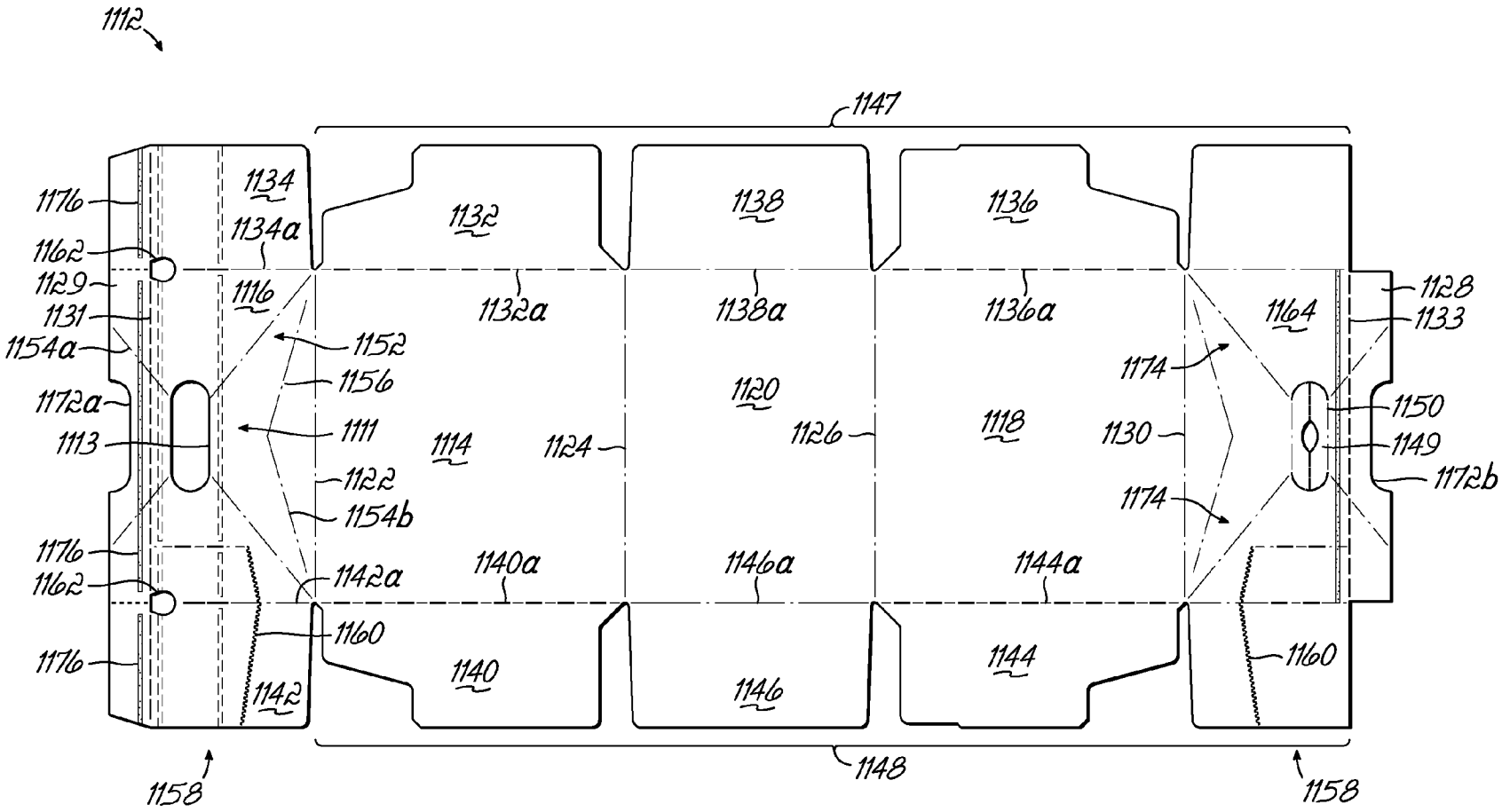

Referring to FIGS. 36 and 37, a blank 1112 according to a still further embodiment of this invention is shown. A carton formed from the blank of FIGS. 36 and 37 is intended to hold beverage containers in a 3×4 matrix in two tiers thereby containing a total of 24 containers in the resulting carton. The blank 1112 includes four primary panels for forming the carton walls, i.e., a first side panel 1114, a top panel 1116, a second side panel 1118 and a bottom panel 20 foldably connected one to the next along fold lines 1122, 1124, 1126. The top panel 1116 is two-ply construction inclusive of a primary reinforcing panel 1164 connected to the side panel 1118. A glue flap 1128 is foldably connected to the panel 1164 along fold line 1133 and similar glue 1129 is connected along fold line 1131 to the top panel 1116. Reference numerals 1132, 1134, 1136, 1138, 1140, 1142, 1144, 1146 designate end flaps foldably connected the ends of the panels 1114, 1116, 1118, 1120, respectively. Each end flap 1132, 1134, 1136, 1138, 1140, 1142, 1144, 1146 is joined to the associated panel 1114, 1116, 1118, 1120 by a fold line 1132*a*, 1134*a*, 1136*a*, 1138*a*, 1140*a*, 1142*a*, 1144*a*, 1146*a*, respectively. The end flaps 1132, 1134, 1136, 1138 arranged along the upper edge (as viewed in FIG. 36) of the blank 1112 form a first composite end wall 1147. The end flaps 1140, 1142, 1144, 1146 arranged along the lower edge of FIG. 36 form a second composite end wall 1148.

FIG. 36 shows a print side of the blank 1112; whereas, FIG. 37 shows the opposite face of a non-print side of the blank 1112. Referring to FIG. 36, the carrying handle 1111 is formed in the top panel 1116 and panel 1164 and includes a pair of handle flaps 1149 joined to a remainder of the panel 1164 by a combination of fold and cut lines 1150 so that when the user grasps the handle 1111, the flap 1149 may be folded inwardly toward the non-print side for convenient use. Handle aperture 1113 is formed in the top panel 1116.

A pattern 1152 of stress-relieving score lines are formed in the blank 1112 surrounding the carrying handle 1111 in the top panel 1116 and panel 1164 and the adjacent top panel 16 of the blank 12 of FIGS. 36-31. The pattern 1152 of stress-relieving score lines includes score lines 1154*a*, 1154*b* radiating angularly outward from opposite ends of the carrying handle 1111. Additional stress-relieving score lines 1156 are formed adjacent the carrying handle 1111 in the top panel 1116 as shown in FIGS. 36-37. The purpose of the stress relieving score lines 1154*a*, 1154*b*, 1156 is to distribute the lifting stresses exerted on the carton so that the top and side panels of the carton do not tear and control or minimize buckling of the carton when lifted.

A dispenser 1158 is formed from appropriate tear lines 1160 and finger holes 1162 in the carton blank 1112 to provide access to the containers C inside the erected carton 1110. The dispenser 1158 shown herein is merely an exemplary dispenser and any of a wide variety of dispenser configurations and designs container be utilized with this invention.

As shown in the blank 12 of embodiments of FIGS. 36-37, the primary reinforcing panel 1164 is joined to the glue flap

1128 adjacent the bottom panel 1118. Handle notches 1172*a*, 1172*b* are provided in each of the panels 1116, 1164, respectively, and are mirror images of one another so that when the panels 1164 and 1116 are in face-to-face juxtaposition, the respective notches 1172*a*, 1172*b* are in alignment and registration with the handle apertures 1113 and 1149.

Additionally, in the primary reinforcing panel 1164, a second pattern 1174 of stress-relieving score lines is provided which are complimentary to the pattern 1152 of stress-relieving score lines in the top panel 1116.

As shown in FIG. 36, glue lines 1176 are provided on the print side of the glue flap 1129. Additionally, as shown in FIG. 37, glue lines 1176 are provided on the non-print side of the glue flaps 1128 to adhere that panel to the panel 1116. The glue line 1176 on the glue flap 1128 adheres the glue flap to the top panel 1116.

The carton and blank embodiments of this invention can be made from any of a number of paperboard materials, including, but not limited to, CRB from 100% recycled pulp, paperboard from non-virgin pulp or other paperboard materials that provide the economic and environmental benefits noted herein along with the requisite tear and other strength parameters. The paperboard thicknesses for cartons and blanks according to this invention are selected to be compatible with the design and strength parameters for a given application while benefiting from the enhanced strength and environmental benefits of this invention.

From the above disclosure of the general principles of this invention and the preceding detailed description of various embodiments, those skilled in the art will readily comprehend the various modifications to which this invention is susceptible. Therefore, we desire to be limited only by the scope of the following claims and equivalents thereof.

We claim:

1. A carton blank to be assembled into a carton for beverage containers, the carton blank comprising:

a plurality of panels including a top panel, a bottom panel and a pair of side panels each joined by one of a plurality of panel fold lines to an adjacent one of the panels;

a glue flap joined by a fold line to one of the plurality of panels;

a plurality of end flaps each joined by one of a plurality of end flap fold lines to one of the panels, the end flaps being adapted to be folded upon selected other end flaps to form composite end panels of the carton;

a carrying handle formed in a selected one of the panels and adapted to be grasped by a user to carry the erected carton when filled with the beverage containers;

a primary reinforcing panel joined to the glue flap such that the primary reinforcing panel may be folded into face to face juxtaposition with a selected one of the panels; and a secondary reinforcing panel joined to a distal edge of the primary reinforcing panel via a secondary reinforcing panel fold line about which the secondary reinforcing panel may be folded into face to face juxtaposition with at least one of the primary reinforcing panel and the selected one of the panels;

handle apertures in each of the primary and secondary reinforcing panels adapted to be registered with the carrying handle when the primary and secondary reinforcing panels are folded into position;

wherein when the primary and secondary reinforcing panels are folded into position the selected one of the panels surrounding the handle and the handle apertures have at least a triple layer of thickness.

2. The blank of claim 1 wherein the carrying handle is positioned laterally off-center on the selected one of the panels.

3. The blank of claim 2 wherein the carrying handle is positioned on the selected one of the panels closer to a first adjacent one of the panels than to a second adjacent one of the panels opposite from the first adjacent one of the panels.

4. The blank of claim 1 further comprising:

a dispenser formed in the blank through which a user may access the beverage containers in the formed carton.

5. The blank of claim 1 in which the selected one of the panels is either one of the side panels or the bottom panel.

6. The blank of claim 1 in which the components thereof are of single piece construction integrally joined together from a single sheet of material.

7. The blank of claim 6 wherein the single sheet of material is paperboard.

8. The blank of claim 1 wherein the glue flap and the primary reinforcing panel are positioned on the same plane and are each in face to face juxtaposition with the selected one of the panels in the erected carton.

9. The carton blank of claim 1 wherein the glue flap is fully covered by one of the panels when the carton blank is formed into the carton.

10. A carton blank to be assembled into a carton for beverage containers, the carton blank comprising:

a plurality of panels including a top panel, a bottom panel and a pair of side panels each joined by one of a plurality of panel fold lines to an adjacent one of the panels;

a glue flap joined by a fold line to one of the plurality of panels;

a plurality of end flaps each joined by one of a plurality of end flap fold lines to one of the panels, the end flaps being adapted to be folded upon selected other end flaps to form composite end panels of the carton;

a carrying handle formed in a selected one of the panels and adapted to be grasped by a user to carry the erected carton when filled with the beverage containers;

a primary reinforcing panel joined to the glue flap such that the primary reinforcing panel may be folded into face to face juxtaposition with a selected one of the panels;

a secondary reinforcing panel joined to a distal edge of the primary reinforcing panel via a secondary reinforcing panel fold line about which the secondary reinforcing panel may be folded into face to face juxtaposition with at least one of the primary reinforcing panel and the selected one of the panels;

wherein when the primary and secondary reinforcing panels are folded into position at least portions of the selected one of the panels surrounding the handle have a triple layer of thickness; and a pattern of stress relieving score lines in the blank positioned relative to the carrying handle so as to distribute lifting stresses exerted on the carton to avoid tearing the panels.

11. A carton blank to be assembled into a carton for beverage containers, the carton blank comprising:

a plurality of panels including a top panel, a bottom panel and a pair of side panels each joined by one of a plurality of panel fold lines to an adjacent one of the panels;

a glue flap joined by a fold line to one of the plurality of panels;

a plurality of end flaps each joined by one of a plurality of end flap fold lines to one of the panels, the end flaps being adapted to be folded upon selected other end flaps to form composite end panels of the carton;

a carrying handle formed in a selected one of the panels and adapted to be grasped by a user to carry the erected carton when filled with the beverage containers;

a primary reinforcing panel joined to the glue flap such that the primary reinforcing panel may be folded into face to face juxtaposition with a selected one of the panels; and a secondary reinforcing panel joined to a distal edge of the primary reinforcing panel via a secondary reinforcing panel fold line about which the secondary reinforcing panel may be folded into face to face juxtaposition with at least one of the primary reinforcing panel and the selected one of the panels;

wherein when the primary and secondary reinforcing panels are folded into position at least portions of the selected one of the panels surrounding the handle have a triple layer of thickness;

wherein the secondary reinforcing panel fold line is generally perpendicular to the fold lines joining the side, top and bottom panels together.

12. A package comprising:

a plurality of beverage containers similarly oriented and arranged in a matrix;

a carton formed around the plurality of beverage containers, the carton further comprising (a) a plurality of panels including a top panel, a bottom panel and a pair of side panels each joined by one of a plurality of panel fold lines to an adjacent one of the panels;

(b) a glue flap joined by a fold line to one of the plurality of panels;

(c) a plurality of end flaps each joined by one of a plurality of end flap fold lines to one of the panels, the end flaps being adapted to be folded upon selected other end flaps to form composite end panels of the carton;

(d) a carrying handle formed in a selected one of the panels and adapted to be grasped by a user to carry the package;

(e) a primary reinforcing panel joined to the glue flap such that the primary reinforcing panel is folded into face to face juxtaposition with a selected one of the panels;

(f) a secondary reinforcing panel joined to a distal edge of the primary reinforcing panel via a secondary reinforcing panel fold line about which the secondary reinforcing panel is folded into face to face juxtaposition with at least one of the primary reinforcing panel and the selected one of the panels; and (g) handle apertures in each of the primary and secondary reinforcing panels in registration with the carrying handle;

wherein the primary and secondary reinforcing panels and the selected one of the panels are generally parallel to one another and combine to provide at least a triple layer of thickness surrounding the carrying handle and the handle apertures for added strength and resistance to tearing of the carton.

13. The package of claim 12 wherein the carrying handle is positioned laterally off-center on the selected one of the panels.

14. The package of claim 12 further comprising:

a dispenser formed in the carton through which a user may access the beverage containers in the carton.

15. The package of claim 12 in which the selected one of the panels is either one of the side panels or the bottom panel.

16. The package of claim 12 in which the components thereof are of single piece construction integrally joined together from a single sheet of paperboard material.

17. The package of claim 12 wherein the glue flap and the primary reinforcing panel are positioned on the same plane and are each in face to face juxtaposition with the selected one of the panels in the carton.

18. The package of claim 12 wherein the glue flap is fully covered by one of the panels when the carton blank is formed into the carton.

19. A package comprising:

a plurality of beverage containers similarly oriented and arranged in a matrix;

a carton formed around the plurality of beverage containers, the carton further comprising (a) a plurality of panels including a top panel, a bottom panel and a pair of side panels each joined by one of a plurality of panel fold lines to an adjacent one of the panels;

(b) a glue flap joined by a fold line to one of the plurality of panels;

(c) a plurality of end flaps each joined by one of a plurality of end flap fold lines to one of the panels, the end flaps being adapted to be folded upon selected other end flaps to form composite end panels of the carton;

(d) a carrying handle formed in a selected one of the panels and adapted to be grasped by a user to carry the package;

(e) a primary reinforcing panel joined to the glue flap such that the primary reinforcing panel is folded into face to face juxtaposition with a selected one of the panels;

(f) a secondary reinforcing panel joined to a distal edge of the primary reinforcing panel via a secondary reinforcing panel fold line about which the secondary reinforcing panel is folded into face to face juxtaposition with at least one of the primary reinforcing panel and the selected one of the panels;

wherein the primary and secondary reinforcing panels and the selected one of the panels are generally parallel to one another and combine to provide a triple layer of thickness proximate the carrying handle for added strength and resistance to tearing of the carton; and a pattern of stress relieving score lines in the carton positioned relative to the carrying handle so as to distribute lifting stresses exerted on the carton to avoid tearing the panels.

20. A package comprising:

a plurality of beverage containers similarly oriented and arranged in a matrix;

a carton formed around the plurality of beverage containers, the carton further comprising (a) a plurality of panels including a top panel, a bottom panel and a pair of side panels each joined by one of a plurality of panel fold lines to an adjacent one of the panels;

(b) a glue flap joined by a fold line to one of the plurality of panels;

(c) a plurality of end flaps each joined by one of a plurality of end flap fold lines to one of the panels, the end flaps being adapted to be folded upon selected other end flaps to form composite end panels of the carton;

(d) a carrying handle formed in a selected one of the panels and adapted to be grasped by a user to carry the package;

(e) a primary reinforcing panel joined to the glue flap such that the primary reinforcing panel is folded into face to face juxtaposition with a selected one of the panels; and (f) a secondary reinforcing panel joined to a distal edge of the primary reinforcing panel via a secondary reinforcing panel fold line about which the secondary reinforcing panel is folded into face to face juxtaposition with at least one of the primary reinforcing panel and the selected one of the panels;

wherein the primary and secondary reinforcing panels and the selected one of the panels are generally parallel to one another and combine to provide a triple layer of thickness proximate the carrying handle for added strength and resistance to tearing of the carton;

wherein the secondary reinforcing panel fold line is generally perpendicular to the fold lines joining the side, top and bottom panels together.

* * * * *